US012180820B1

(12) United States Patent
Smith et al.

(10) Patent No.: US 12,180,820 B1
(45) Date of Patent: Dec. 31, 2024

(54) DRILLING A WELLBORE INTO A MAGMA RESERVOIR

(71) Applicant: EnhancedGEO Holdings, LLC, St. Petersburg, FL (US)

(72) Inventors: Benjamin Chris Smith, Humble, TX (US); James Michael Browning, Houston, TX (US); Randall Howard Hornbaker, Houston, TX (US); Kevin Martin Stone, Houston, TX (US); Georgios Evangelatos, Athens (GR); Shamsul Abedin Al-Tomal, Houston, TX (US); Andrew Nguyen, Richmond, TX (US)

(73) Assignee: EnhancedGEO Holdings, LLC, St. Petersburg, FL (US)

( * ) Notice: Subject to any disclaimer, the term of this patent is extended or adjusted under 35 U.S.C. 154(b) by 0 days.

(21) Appl. No.: 18/373,630

(22) Filed: Sep. 27, 2023

(51) Int. Cl.
*E21B 44/00* (2006.01)
*E21B 21/08* (2006.01)
*E21B 49/00* (2006.01)

(52) U.S. Cl.
CPC ..... *E21B 44/00* (2013.01); *E21B 21/08* (2013.01); *E21B 49/005* (2013.01)

(58) Field of Classification Search
CPC ..... E21B 44/00; E21B 21/08; E21B 49/005
See application file for complete search history.

(56) References Cited

U.S. PATENT DOCUMENTS 1,043,129 A 11/1912 Murphy
3,498,381 A 3/1970 Earlougher, Jr.
3,613,806 A 10/1971 Malott
3,757,516 A 9/1973 Mc
3,765,477 A 10/1973 Van
3,864,208 A 2/1975 Van
3,950,949 A 4/1976 Martin et al.
3,957,108 A 5/1976 Huisen
3,967,675 A 7/1976 Georgii
4,043,129 A 8/1977 McCabe et al.
4,047,093 A 9/1977 Levoy
4,054,176 A 10/1977 Huisen
4,057,108 A 11/1977 Broussard
(Continued)

FOREIGN PATENT DOCUMENTS

AU 2018308861 A1 1/2020
AU 2017268378 B2 9/2021
(Continued)

OTHER PUBLICATIONS

Boehm, R.F. et al., Modelling of a Magma Energy Geothermal Power Plant, presented at ASME Winter Annual Meeting, Boston MA, Dec. 1987, SAND-87-0564C, DE88 003793, 11 pages.
(Continued)

*Primary Examiner* — Brad Harcourt
(74) *Attorney, Agent, or Firm* — Stephen Y. Liu; James H. Ortega; Carstens, Allen & Gourley, LLP

(57) ABSTRACT

A method for preparing a geothermal system involves preparing a wellbore that extends into an underground magma reservoir. Characteristics of the drilling process and the borehole are monitored to detect when the magma reservoir is reached, such that specially configured drilling operations can be performed to drill to a target depth within the magma reservoir.

21 Claims, 14 Drawing Sheets

(56) References Cited

U.S. PATENT DOCUMENTS

| | | | | |
|---|---|---|---|---|
| 4,116,285 | A | 9/1978 | Guerber | |
| 4,140,184 | A * | 2/1979 | Bechtold | E21B 43/24 166/266 |
| 4,492,083 | A | 1/1985 | McCabe et al. | |
| 4,642,987 | A | 2/1987 | Csorba et al. | |
| 4,665,705 | A | 5/1987 | Bonham, Jr. | |
| 4,776,169 | A | 10/1988 | Coles, Jr. | |
| 4,929,348 | A | 5/1990 | Rice | |
| 5,513,573 | A | 5/1996 | Sutton | |
| 5,860,279 | A | 1/1999 | Bronicki et al. | |
| 5,911,684 | A | 6/1999 | Shnell | |
| 6,708,494 | B1 | 3/2004 | Hamann | |
| 7,124,584 | B1 | 10/2006 | Wetzel et al. | |
| 8,011,450 | B2 | 9/2011 | Krueger et al. | |
| 8,047,285 | B1 | 11/2011 | Smith | |
| 8,201,409 | B1 | 6/2012 | Zakiewicz | |
| 8,524,787 | B2 | 9/2013 | Ermolaev et al. | |
| 9,006,298 | B2 | 4/2015 | Leviness et al. | |
| 9,108,858 | B2 | 8/2015 | McDonald et al. | |
| 9,150,423 | B2 | 10/2015 | Hosono et al. | |
| 9,182,149 | B2 | 11/2015 | Gilaberte et al. | |
| 9,298,756 | B1 | 3/2016 | Johnson | |
| 9,359,271 | B2 | 6/2016 | Leviness et al. | |
| 9,388,797 | B2 | 7/2016 | Bronicki | |
| 9,574,551 | B2 | 2/2017 | Parrella et al. | |
| 9,738,835 | B2 | 8/2017 | Schrauwen | |
| 9,765,605 | B2 | 9/2017 | Williamson et al. | |
| 10,017,395 | B2 | 7/2018 | Kageyama et al. | |
| 10,058,848 | B2 | 8/2018 | Lipiec et al. | |
| 10,131,545 | B2 | 11/2018 | Sekine et al. | |
| 10,173,202 | B2 | 1/2019 | Hosono et al. | |
| 10,203,162 | B2 | 2/2019 | Yokomine et al. | |
| 10,322,940 | B2 | 6/2019 | Hosono et al. | |
| 10,344,233 | B2 | 7/2019 | Lucas et al. | |
| 10,358,604 | B2 | 7/2019 | Harris et al. | |
| 10,710,049 | B2 | 7/2020 | Mikhajlov et al. | |
| 10,745,625 | B2 | 8/2020 | Dogterom et al. | |
| 10,759,668 | B2 | 9/2020 | Hosono et al. | |
| 10,792,645 | B2 | 10/2020 | Hosono et al. | |
| 10,974,969 | B2 | 4/2021 | Hu et al. | |
| 11,131,484 | B2 | 9/2021 | Mcbay | |
| 11,235,310 | B2 | 2/2022 | Hosono et al. | |
| 11,286,169 | B2 | 3/2022 | Beach et al. | |
| 11,325,105 | B2 | 5/2022 | Beach et al. | |
| 2004/0265158 | A1 | 12/2004 | Boyapati et al. | |
| 2006/0026961 | A1 | 2/2006 | Bronicki | |
| 2006/0180537 | A1 | 8/2006 | Loftis et al. | |
| 2006/0277917 | A1 | 12/2006 | Hsu | |
| 2008/0213157 | A1 | 9/2008 | McGrady et al. | |
| 2009/0226308 | A1 | 9/2009 | Vandor | |
| 2010/0025260 | A1 | 2/2010 | Naterer et al. | |
| 2010/0045042 | A1 | 2/2010 | Hinders et al. | |
| 2012/0144829 | A1 | 6/2012 | Wiggs et al. | |
| 2013/0101492 | A1 | 4/2013 | McAlister | |
| 2013/0232973 | A1 | 9/2013 | McBay | |
| 2013/0234444 | A1 | 9/2013 | Rogers et al. | |
| 2013/0333383 | A1 | 12/2013 | Schwarck | |
| 2014/0262137 | A1 | 9/2014 | McBay | |
| 2015/0128931 | A1 | 5/2015 | Joshi et al. | |
| 2015/0300327 | A1 | 10/2015 | Sweatman et al. | |
| 2015/0368565 | A1 | 12/2015 | Schrauwen | |
| 2015/0377211 | A1 | 12/2015 | Occhiello | |
| 2016/0097376 | A1 | 4/2016 | Wasyluk et al. | |
| 2016/0115945 | A1 | 4/2016 | Barsi et al. | |
| 2016/0363350 | A1 | 12/2016 | Tahara | |
| 2017/0253492 | A1 | 9/2017 | Beach et al. | |
| 2018/0106138 | A1 | 4/2018 | Randolph | |
| 2018/0224164 | A1 | 8/2018 | Lakic | |
| 2020/0040267 | A1 | 2/2020 | Willigenburg et al. | |
| 2020/0072199 | A1 | 3/2020 | Fontana et al. | |
| 2020/0231455 | A1 | 7/2020 | Beach et al. | |
| 2020/0325030 | A1 | 10/2020 | Cussler et al. | |
| 2020/0353518 | A1 | 11/2020 | Chandran et al. | |
| 2021/0114005 | A1 | 4/2021 | Tao et al. | |
| 2021/0122656 | A1 | 4/2021 | Willberg et al. | |
| 2023/0130169 | A1 | 4/2023 | McIntyre | |

FOREIGN PATENT DOCUMENTS

| | | | |
|---|---|---|---|
| AU | 2016398360 | B2 | 1/2022 |
| CN | 105148824 | A | 12/2015 |
| CN | 108952650 | A | 12/2018 |
| CN | 112604697 | A | 4/2021 |
| CN | 113494273 | A | 10/2021 |
| CN | 113562692 | A | 10/2021 |
| EP | 0236640 | A1 | 9/1987 |
| EP | 0326736 | A2 | 8/1989 |
| EP | 2792010 | B1 | 1/2018 |
| EP | 3583321 | A1 | 12/2019 |
| GB | 2592695 | A | 9/2021 |
| GB | 2615913 | A | 8/2023 |
| JP | h07286760 | A | 10/1995 |
| JP | 2011052621 | A | 3/2011 |
| JP | 2014202149 | A | 10/2014 |
| JP | 2020067027 | A | 4/2020 |
| WO | 2009116873 | A1 | 9/2009 |
| WO | 2012079078 | A2 | 6/2012 |
| WO | 2012037571 | A3 | 7/2012 |
| WO | 2013025640 | A2 | 2/2013 |
| WO | 2016204287 | A1 | 12/2016 |
| WO | 2020150245 | A1 | 7/2020 |
| WO | 2020160500 | A1 | 8/2020 |
| WO | 2021257944 | A9 | 4/2022 |
| WO | 2022123626 | A1 | 6/2022 |
| WO | 2022211643 | A1 | 10/2022 |

OTHER PUBLICATIONS

Colp, John L., Final Report—Magma Energy Research Project, Sandia Report, Sand82-2377, Unlimited Release, UC-66, prepared by Sandia National Laboratories under contrace DE-AC04-76DP00789, Printed Oct. 1982, 42 pages.

* cited by examiner

DRILLING A WELLBORE INTO A MAGMA RESERVOIR

PRIORITY CLAIM AND RELATED APPLICATIONS

The present disclosure claims priority to Greek patent application No. 20230100720, filed Sep. 8, 2023, which is herein incorporated by reference in its entirety for all purposes.

TECHNICAL FIELD

The present disclosure relates generally to drilling processes and more particularly to drilling a wellbore into a magma reservoir.

BACKGROUND

Solar power and wind power are commonly available sources of renewable energy, but both can be unreliable and have relatively low power densities. In contrast, geothermal energy can potentially provide a higher power density and can operate in any weather condition or during any time of day. However, there exists a lack of tools for effectively harnessing geothermal energy.

SUMMARY

This disclosure recognizes the previously unidentified and unmet need for processes and systems for preparing wellbores that extend into underground chambers of magma, or magma reservoirs, such as dikes, sills, or other magmatic formations. This disclosure provides a solution to this unmet need in the form of systems and processes for safely and reliably preparing such wellbores. The preparation of such wellbores may be facilitated by monitoring characteristics of the drilling equipment, such as torque on a drill bit, weight of a drill bit, and pumping pressure, along with characteristics of the wellbore or borehole being prepared to detect when different drilling modes should be adopted to drill through the magma reservoir and the transition zone of ductile rock that surrounds the magma reservoir. This disclosure also provides improved operating parameters for drilling through these regions.

In some embodiments, the processes and systems described in this disclosure facilitate the preparation of a geothermal system that exchanges heat with an underground magma reservoir using a closed heat-transfer loop in which a heat transfer fluid can be pumped into the casing, heated via contact with the underground magma reservoir, and returned to the surface to facilitate one or more thermally driven processes. As an example, the underground magma reservoir may uniquely facilitate the generation of high-temperature, high-pressure steam (or another high temperature fluid), while avoiding problems and limitations associated with previous geothermal technology.

Geothermal systems that can be achieved according to various examples of this disclosure may harness heat from a magma reservoir with a sufficient energy density from magmatic activity, such that the geothermal resource does not degrade significantly over time. As such, this disclosure illustrates processes for achieving improved systems and methods for capturing energy from magma reservoirs, including dikes, sills, and other magmatic formations, that are significantly higher in temperature than heat sources that are accessed using previous geothermal technologies and that can contain an order of magnitude higher energy density than the geothermal fluids that power previous geothermal technologies. In some cases, the present disclosure can significantly decrease costs and improve reliability of processes used to establish a geothermal wellbore that extends into a magma reservoir. In some cases, the present disclosure may facilitate more efficient electricity production and/or other processes in regions where access to reliable power is currently unavailable or transport of non-renewable fuels is challenging.

Certain embodiments may include none, some, or all of the above technical advantages. One or more technical advantages may be readily apparent to one skilled in the art from figures, description, and claims included herein.

BRIEF DESCRIPTION OF THE FIGURES

For a more complete understanding of the present disclosure, reference is now made to the following description, taken in conjunction with the accompanying drawings and detailed description, in which like reference numerals represent like parts.

FIG. 5A shows an initial section of a wellbore drilled toward a magma reservoir FIG. 5B shows the wellbore of FIG. 5A after further drilling is performed to reach a transition zone between a rock layer and the magma reservoir. FIG. 5C shows the initial section of the wellbore of FIG. 5B with an intermediate casing disposed inside the wellbore. FIG. 5D shows the wellbore after the drill bit enters the magma reservoir and drilling/cooling fluid is used to form a rock plug in the magma reservoir. FIG. 5E shows the wellbore after a target depth is reached in the magma reservoir and an internal casing and fluid conduit are installed in the wellbore. FIG. 5F shows the completed wellbore after the rock plug in the magma reservoir is allowed to remelt, allowing the magma to contact the internal casing and form a rock layer proximate the outer wall of the internal casing.

DETAILED DESCRIPTION

Embodiments of the present disclosure and its advantages will become apparent from the following detailed description when considered in conjunction with the accompanying figures. In the figures, each identical, or substantially similar component that is illustrated in various figures is represented by a single numeral or notation. For purposes of clarity, not every component is labeled in every figure, nor is every component of each embodiment shown where illustration is not necessary to allow those of ordinary skill in the art to understand the disclosure.

As used herein, "magma" refers to extremely hot liquid and semi-liquid rock under the Earth's surface. Magma is formed from molten or semi-molten rock mixture found typically between 1 km to 10 km under the surface of the Earth. As used herein, "borehole" generally refers to a hole that is drilled to aid in the exploration and recovery of natural resources, including oil, gas, water, or heat from below the surface of the Earth. As used herein, a "wellbore" generally refers to a borehole either alone or in combination with one or more other components disposed within or in connection with the borehole in order to perform exploration and/or recovery processes. In some instances, the terms wellbore and borehole are used interchangeably. As used herein, "fluid conduit" refers to any structure, such as a pipe, tube, or the like, used to transport fluids. As used herein, "heat transfer fluid" refers to a fluid, e.g., a gas or liquid, that takes part in heat transfer by serving as an intermediary in cooling on one side of a process, transporting and storing thermal energy, and heating on another side of a process. Heat transfer fluids are used in processes requiring heating or cooling.

Figure 1:
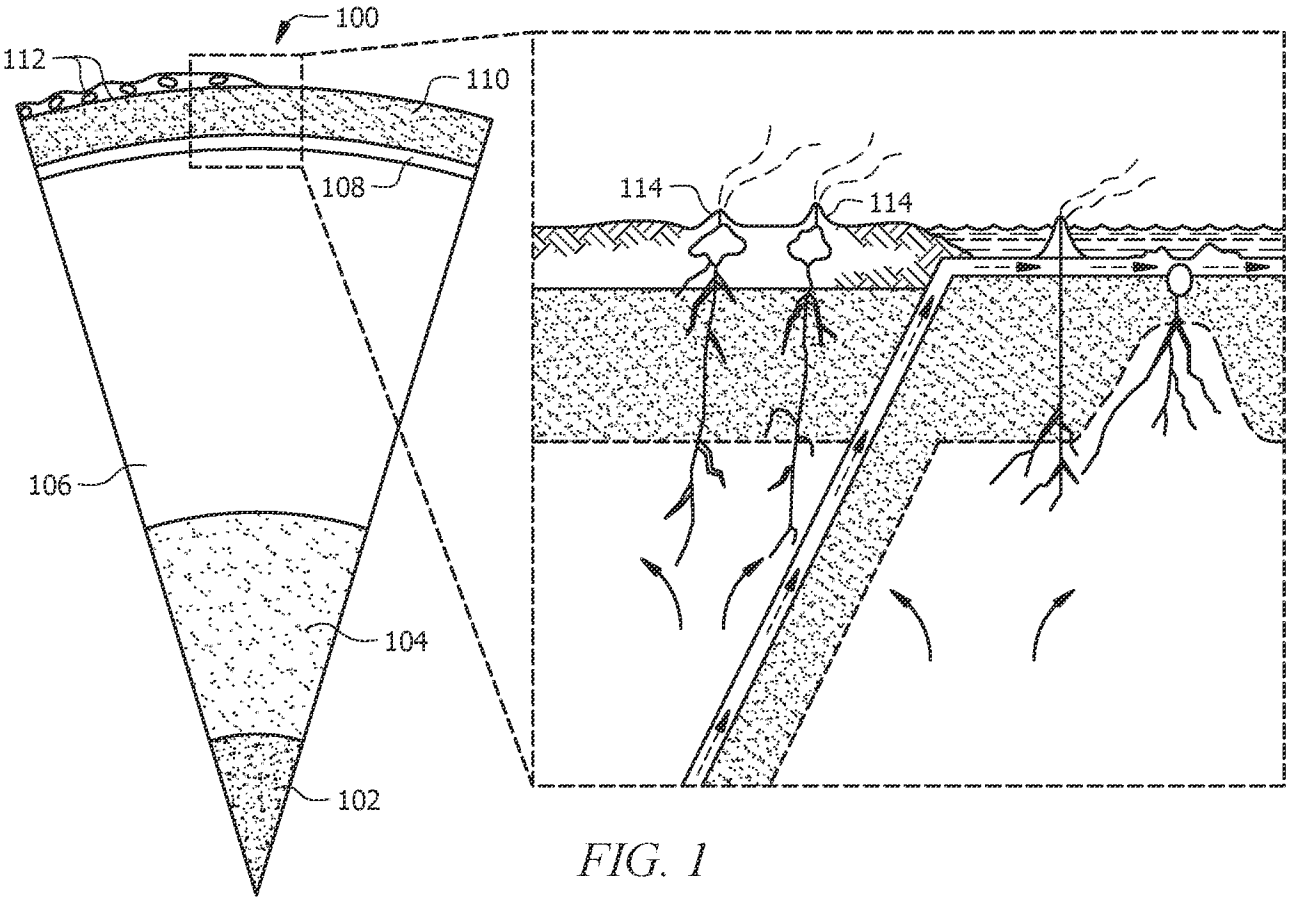
FIG. 1 is a diagram of underground regions near a tectonic plate boundary in the Earth.

FIG. 1 is a partial cross-sectional diagram of the Earth depicting underground formations that can be tapped by geothermal systems of this disclosure (e.g., for generating geothermal power). The Earth is composed of an inner core 102, outer core 104, lower mantle 106, transitional region 108, upper mantle 110, and crust 112. There are places on the Earth where magma reaches the surface of the crust 112 forming volcanoes 114. Magma can heat ground water to temperatures sufficient for certain geothermal power production. However, for other applications, such as geothermal energy production, more direct heat transfer with the magma is desirable.

Figure 2:
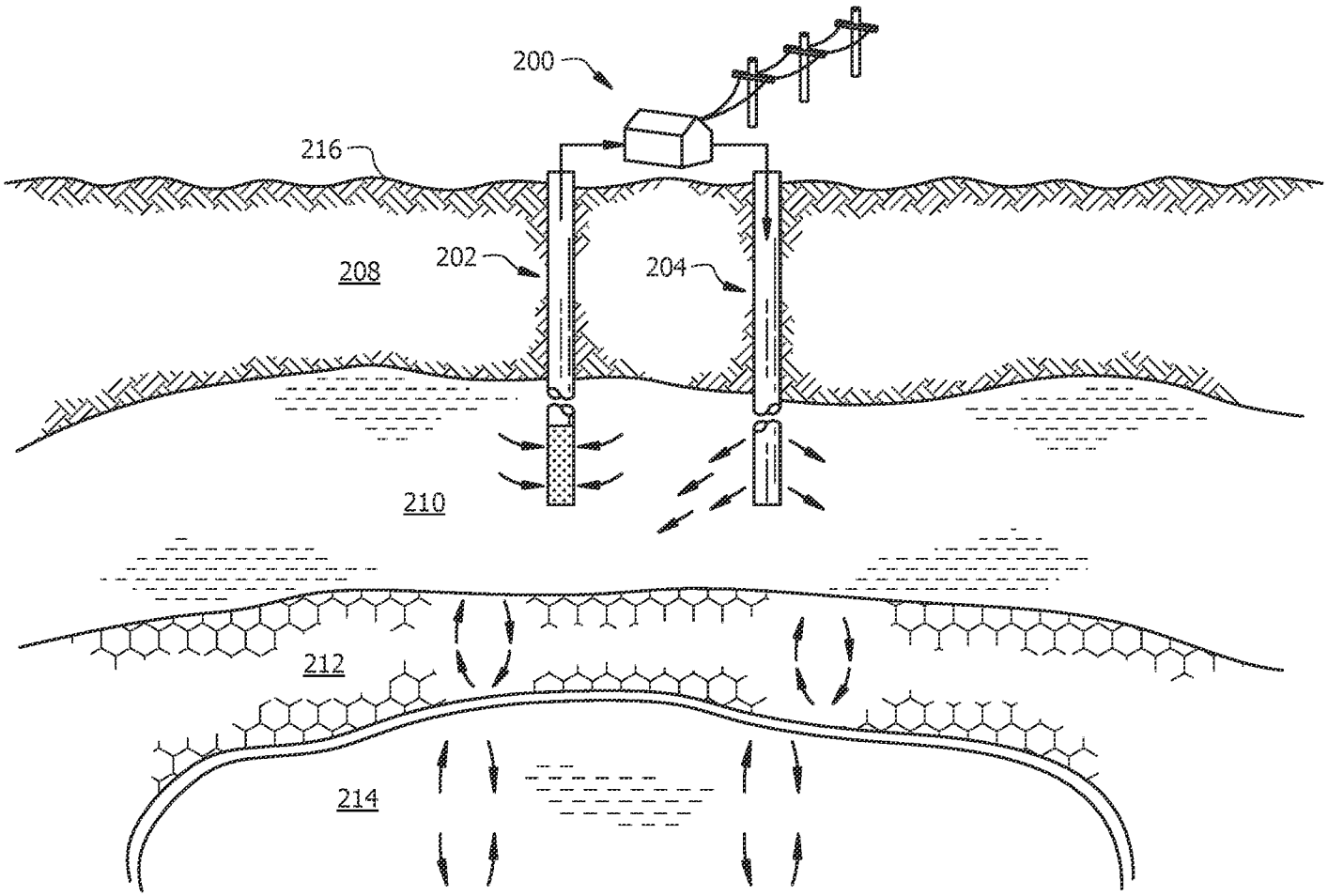
FIG. 2 is a diagram of a previous geothermal system.

FIG. 2 illustrates a conventional geothermal power generation system 200 that harnesses energy from heated ground water. The geothermal system 200 is a "flash-plant" that generates power from high-temperature, high-pressure geothermal water extracted from a production well 202. The production well 202 is drilled through rock layer 208 and into the hydrothermal layer 210 that serves as the source of geothermal water. The geothermal water is heated indirectly via heat transfer with intermediate layer 212, which is in turn heated by magma reservoir 214. Magma reservoir 214 can be any underground region containing magma such as a dike, sill, or the like. Convective heat transfer (illustrated by the arrows indicating that hotter fluids rise to the upper portions of their respective layers before cooling and sinking, then rising again) may facilitate heat transfer between these layers. Geothermal water from layer 210 flows to the surface 216 and is used for geothermal power generation. The geothermal water (and possibly additional water or other fluids) is then injected back into layer 210 via injection well 204.

The configuration of conventional geothermal system 200 of FIG. 2 suffers from drawbacks and disadvantages, as recognized by this disclosure. For example, because geothermal water is a multicomponent mixture (i.e., not pure water), the geothermal water flashes at various points along its path up to the surface 216, creating water hammer, which results in a large amount of noise and potential damage to system components. The geothermal water is also prone to causing scaling and corrosion of system components. Chemicals may be added to partially mitigate these issues, but this may result in considerable increases in operational costs and increased environmental impacts, since these chemicals are generally introduced into the environment via injection well 204.

Example Improved Geothermal System

Figure 3:
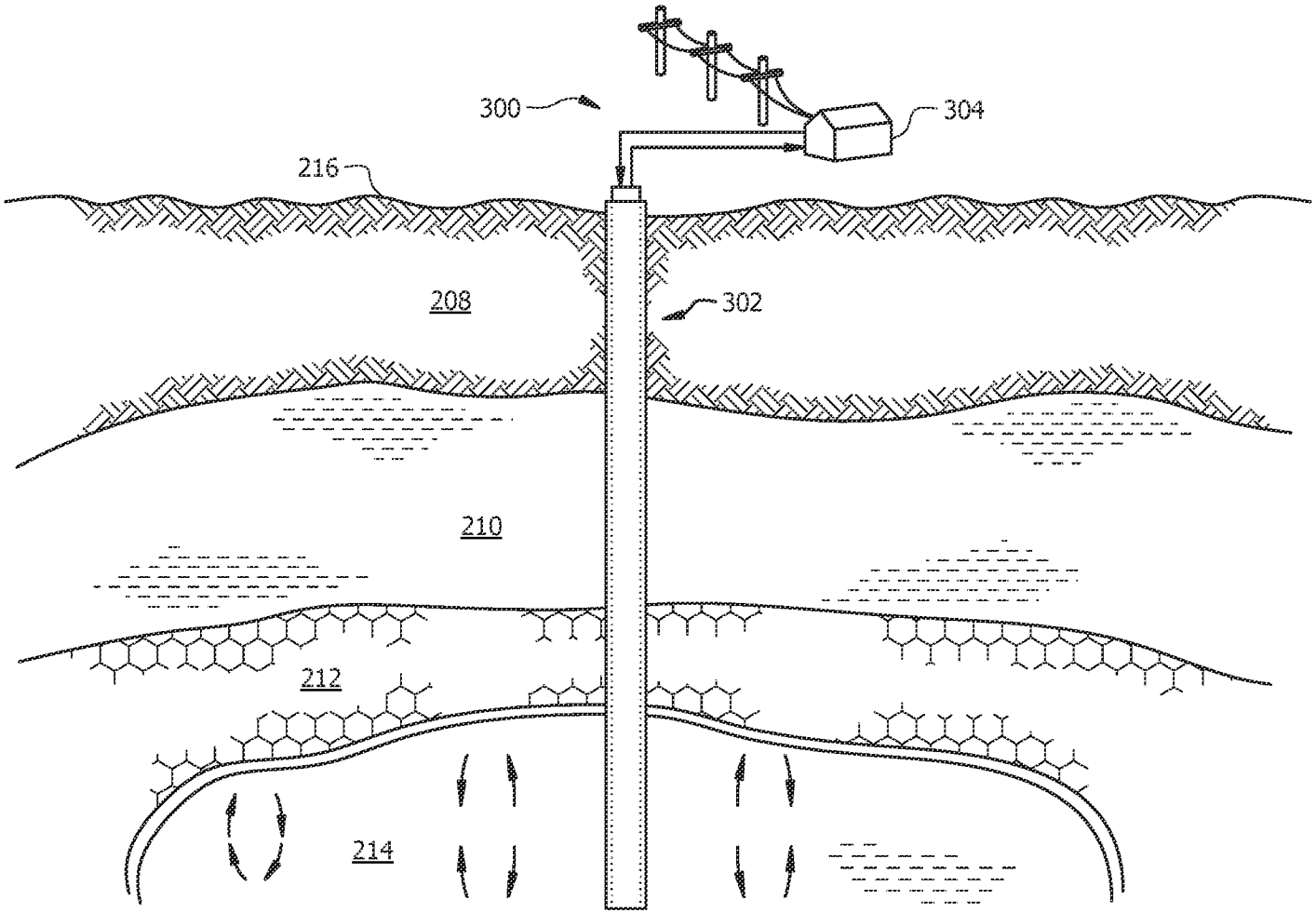
FIG. 3 is a diagram of an example improved geothermal system of this disclosure.

FIG. 3 illustrates an example magma-based geothermal system 300 that can be achieved using the systems and processes of this disclosure. The geothermal system 300 includes a wellbore 302 that extends from the surface 216 at least partially into the magma reservoir 214. The geothermal system 300 is a closed system in which a heat transfer fluid is provided down the wellbore 302 to be heated and returned to a thermal or heat-driven process system 304 (e.g., for power generation and/or any other thermal processes of interest). As such, geothermal water is not extracted from the Earth, resulting in significantly reduced risks associated with the conventional geothermal system 200 of FIG. 2, as described further below. Heated heat transfer fluid is provided to the thermal process system 304. The thermal process system 304 is generally any system that uses the heat transfer fluid to drive a process of interest. For example, the thermal process system 304 may include an electricity generation system and/or support thermal processes requiring higher temperatures/pressures than could be reliably or efficiently obtained using previous geothermal technology, such as the system 200 of FIG. 2. Further details of components of an example thermal process system 304 are provided with respect to FIG. 7 below.

The geothermal system 300 provides technical advantages over previous geothermal systems, such as the conventional geothermal system 200 of FIG. 2. The geothermal system 300 can achieve higher temperatures and pressures for increased energy generation (and/or for more effectively driving other thermal processes). For example, because of the high energy density of magma in magma reservoir 214 (e.g., compared to that of geothermal water of layer 210), a single wellbore 302 can generally create the power of many wells of the conventional geothermal system 200 of FIG. 2. Furthermore, the geothermal system 300 has little or no risk of thermal shock-induced earthquakes, which might be attributed to the injection of cooler water into a hot geothermal zone, as is performed using the previous geothermal system 200 of FIG. 2. Furthermore, the heat transfer fluid is generally not substantially released into the geothermal zone by geothermal system 300, resulting in a decreased environmental impact and decreased use of costly materials (e.g., chemical additives that are used and introduced to the environment in great quantities during some conventional geothermal operations). The geothermal system 300 may also have a simplified design and operation compared to those of previous systems. For instance, fewer components and reduced complexity may be needed at the thermal process system 304 because only clean heat transfer fluid (e.g., steam) reaches the surface 216. There may be no need or a reduced need to separate out solids or other impurities that are common to geothermal water.

The example geothermal system 300 may include further components not illustrated in FIG. 3. Further details and examples of different configurations of geothermal systems and methods of their design, preparation, construction, and operation are described in U.S. patent application Ser. No. 18/099,499, filed Jan. 20, 2023, and titled "Geothermal Power from Superhot Geothermal Fluid and Magma Reservoirs"; U.S. patent application Ser. No. 18/099,509, filed Jan. 20, 2023, and titled "Geothermal Power from Superhot Geothermal Fluid and Magma Reservoirs"; U.S. patent application Ser. No. 18/099,514, filed Jan. 20, 2023, and titled "Geothermal Power from Superhot Geothermal Fluid and Magma Reservoirs"; U.S. patent application Ser. No. 18/099,518, filed Jan. 20, 2023, and titled "Geothermal Power from Superhot Geothermal Fluid and Magma Reservoirs"; U.S. patent application Ser. No. 18/105,674, filed Feb. 3, 2023, and titled "Wellbore for Extracting Heat from Magma Chambers"; U.S. patent application Ser. No. 18/116,693, filed Mar. 2, 2023, and titled "Geothermal Systems and Methods with an Underground Magma Chamber"; U.S. patent application Ser. No. 18/116,697, filed Mar. 2, 2023, and titled "Method and System for Preparing a Geothermal System with a Magma Chamber"; and U.S. Provisional Patent Application No. 63/444,703, filed Feb. 10, 2023, and titled "Geothermal Systems and Methods Using Energy from Underground Magma Reservoirs", the entireties of each of which are hereby incorporated by reference.

Example Magma Drilling System

Figure 4:
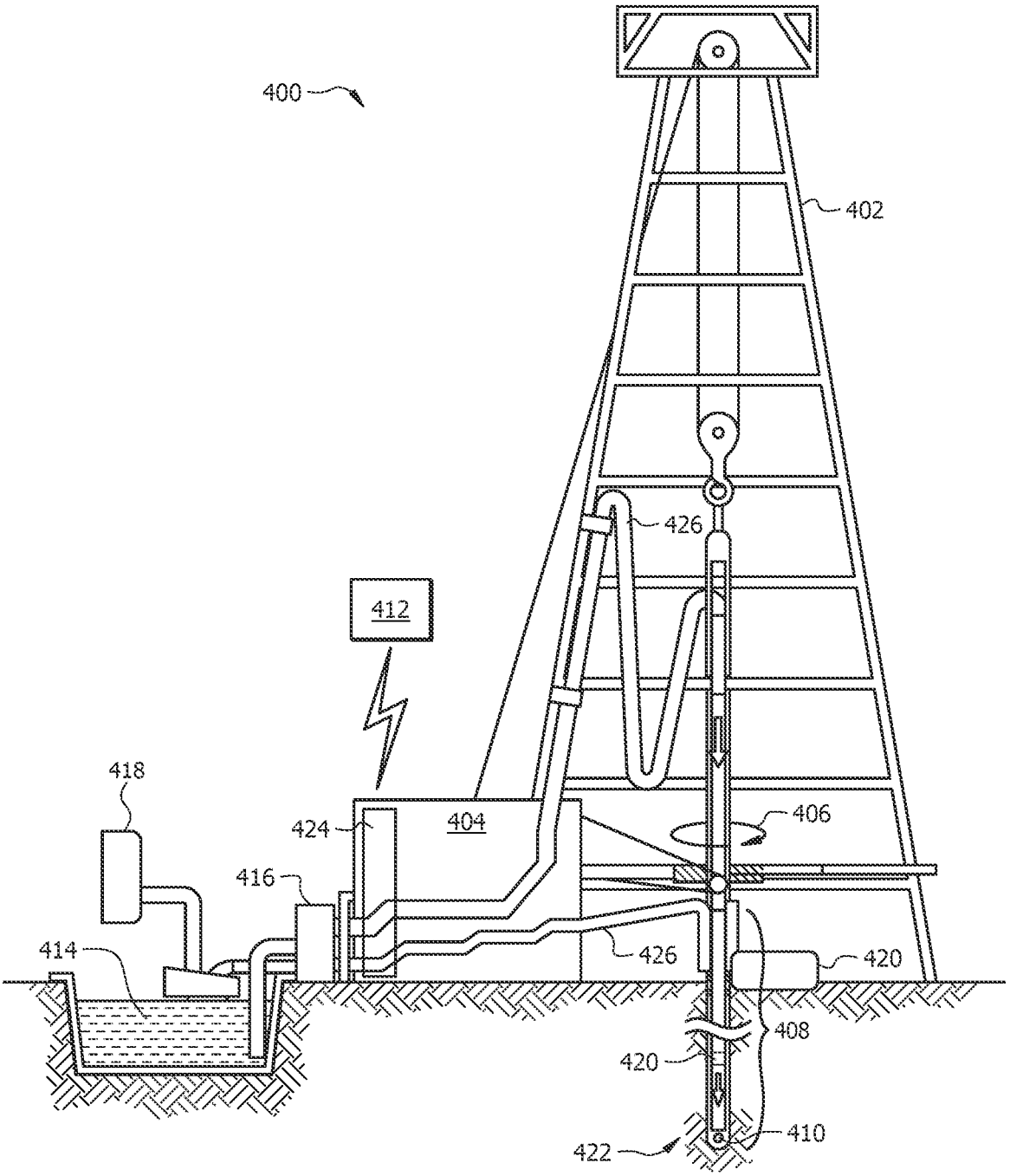
FIG. 4 is an example of a drilling system for preparing a wellbore extending into a magma reservoir, as shown in FIGS. 3 and 5D-5F.

FIG. 4 illustrates an example drilling system 400 that may be used to prepare a borehole 422 extending into a magma reservoir 214. Borehole 422 may, for example, correspond to a partially completed stage of wellbore 302 of FIG. 3 (described above) and/or the wellbores 500*a-f* of FIGS. 5A-5F (described below). The example drilling system 400 of FIG. 4 includes a derrick 402, motor(s) 404, a drive system 406, a bottom hole assembly 408 with a drill bit 410 and drill string, a drilling fluid tank 414, a cooler 416, a sampling device 418, sensor(s) 420, and pump(s) 424. The example drilling system 400 is provided for example only. Other known or to-be developed drilling equipment may be employed to drill a wellbore extending into a magma reservoir 214 according to the approaches described in this disclosure. The drilling system 400 can include more, fewer, or alternative components.

The derrick 402 provides structural support for other components of the drilling system 400 and facilitates the lowering and lifting of the bottom hole assembly 408 using these components. For example, the derrick 402 may be a supporting tower that holds other components of the drilling system 400. The derrick 402 may have any appropriate structure, including the one illustrated FIG. 4. The derrick 402 may include a support block that supports a drill line used to move a traveling block connected to the bottom hole assembly 408.

The motor(s) 404 provide mechanical energy for performing various operations of the drilling system 400, such as rotating the drill bit 410, raising/lowering the bottom hole assembly 408, pumping fluid through the borehole 422, and the like. For example, a motor 404 may be coupled to the drive system 406, described further below, to facilitate rotation of the drill bit 410. A motor 404 may also or alternatively facilitate the lowering and raising of the bottom hole assembly 408. For example, a motor 404 may be powered to pull the bottom hole assembly 408 out of the borehole 422 or shut down (or be powered at a lower level) to allow the bottom hole assembly 408 to be lowered into the borehole 422. A motor 404 may also or alternatively provide pumping operations, such as pumping drilling fluid into the borehole 422 using pump 424.

Motor(s) 404 may be communicatively coupled to the drilling controller 412, as described further below. For example, the drilling controller 412 may monitor and/or control power provided by motor(s) 404 to drive system 406. The drilling controller 412 may monitor the torque of the drill bit 410 during drilling the borehole 422. As another example, the drilling controller 412 may monitor and/or control power provided by motor(s) 404 to move the bottom hole assembly 408 to move it into and out of the borehole 422. The drilling controller 412 may monitor the weight on a drill bit used to drill the borehole 422.

The drive system 406 imparts a rotational force or torque to the drill bit 410 (e.g., by rotating components of the drill bit 410 itself and/or rotating a drill string to which the drill bit 410 is attached). The drive system 406 may include a swivel, kelly drive, and turntable, or other components as would be appreciated by one of skill in the art. The drive system 406 may be a top drive or other appropriate equipment for generating appropriate rotation of the drill bit 410.

The bottom hole assembly 408 may include the lower portion of the drill string, including, for example, the drill bit 410, a bit sub, a mud motor (in some cases), stabilizers, drill collars, heavyweight drill pipe, jarring devices, crossovers for various thread forms, and the like. The bottomhole assembly 408 can also include directional drilling and measuring equipment, such as sensors 420 for measuring properties inside the borehole 422 during a drilling process. The drill bit 410 can be any appropriate type of currently used or future-developed drill bit for forming the borehole 422.

A wellhead may be placed at the surface that includes fluid connections, valves, and the like for facilitating appropriate operation of the drilling system 400. For example, a wellhead may include one or more valves to help control pressure within the borehole 422. The wellhead may include a relief valve for venting fluid from the borehole 422 if an excessive pressure is reached.

The drilling fluid tank 414 is any vessel capable of holding drilling fluid that is provided down the borehole 422 during various stages of a drilling process. More details of example drilling processes are provided below with respect to FIGS. 5A-5F and 6. In general, drilling fluid is provided through the borehole 422 to aid in removing cuttings during drilling and/or to cool the borehole 422 (e.g., to form the rock plug 524 of FIG. 5D to aid in drilling through a magma reservoir 214).

The cooler 416 can be operated to cool the drilling fluid from the drilling fluid tank 414 before it is provided to the borehole 422. The cooler 416 may be any type of refrigeration unit or other device capable of cooling the drilling fluid. The cooler 416 may be operated when a decreased temperature is needed to obtain desired conditions in the borehole 422, such as to maintain an appropriate operating temperature and/or pressure in the borehole 422 and/or to successfully drill into the magma reservoir (e.g., by forming the rock plug 524 of FIG. 5D).

The fluid pump 424 facilitates flow of drilling fluid into and out of the borehole 422. The fluid pump 424 is any appropriate pump capable of pumping drilling fluid. The fluid pump 424 may be powered by a motor 404. In the example of FIG. 4, fluid tank 414 stores drilling fluid that is pumped through fluid conduit 426 leading into and out of the borehole 422. The returned drilling fluid from conduit 426 may be filtered before being returned to the fluid tank 414. The fluid pump 424 may be communicatively coupled to the drilling controller 412. For example, the drilling controller 412 may monitor and/or control power provided to pump 424 to pump fluid into and/or out of the borehole 422. The drilling controller 412 may monitor a pump pressure provided by pump 424 during drilling of the borehole 422.

A sampling device 418 may be operated to measure properties of the drilling fluid and/or cuttings returned from the borehole 422. For example, the sampling device 418 may collect cuttings and aid in analyzing the collected cuttings. For example, the sampling device 418 may be a mud logging tool that facilitates analyses of the drilling fluid (sometimes referred to as "mud") returned from the borehole 422. As described further below, properties of the returned drilling fluid and/or the cuttings may be used to determine when the drill bit 410 has entered a transition zone between rock layers and the magma reservoir 214 and/or to determine when the drill bit 410 has reached the magma reservoir 214. One or more of the sensors 420 measure chemical and/or physical properties in drilling fluid returned from the borehole 422. For example, sensors 420 may measure pH, dissolved solids, turbidity, and the like. Sensors 420 and/or sampling device 418 may alone or in combination provide a means for logging while drilling. For example, the sensors 420 and/or sampling device 418 may include tools used to measure resistivity in materials being drilled, obtain images inside the wellbore 500*c*, and the like.

The sensor(s) 420 may be positioned at various locations in, on, or around the drilling system 400 and/or in the borehole 422 to monitor a drilling process. For example, one or more sensors 420 may measure the amount of one or more gaseous species returned from the borehole 422. For example, sensors 420 shown at the top of the borehole 422 may be sensors for measuring gaseous species, such as hydrogen sulfide gas, sulfate gases, chlorinated gases, fluorine gas, helium gas, and/or any other gaseous species related to a drilling operation.

As another example, one or more of the sensors 420 may be temperature sensors that measure temperatures in the borehole 422 and/or of drilling fluid provided into and/or received from the borehole 422. As an example, sensors 420 at the top of the borehole 422 may be positioned to measure the temperature of drilling fluid provided into the borehole 422 and the temperature of the drilling fluid returned from the borehole 422. A difference between these temperatures may be used to control operations of the drilling system 400, such as by changing a drilling rate, changing a rate at which drilling fluid is provided to the borehole 422, changing an amount of cooling provided by the cooler 416, and the like. In some cases, a sensor 420 may be located within the borehole 422 (e.g., on the bottom hole assembly 408 or otherwise positioned within the borehole 422). The temperature within the borehole 422 may similarly be used to control operation of the drilling system 400.

As another example, a sensor 420 may be a vibrational or acoustic sensor capable of detecting vibrations within the Earth. Vibrational or acoustic data (e.g., indicating seismic properties) indicating vibrations within the region proximate the borehole 422 may be used to direct operations of the drilling system 400. For example, a pattern of vibrations (e.g., amplitude and/or frequency of vibrations) may be determined that is known to be associated with a drill bit entering a transition zone and/or a magma reservoir 214. When this vibrational pattern is detected, the drilling system 400 may be operated accordingly to more effectively drill through these regions, as described in greater detail below with respect to FIGS. 5A-5F and 6.

The drilling controller 412 is a combination of hardware and software that helps direct operations of the drilling system 400. Further details of an example drilling controller 412 are provided below with respect to FIG. 9. In general, the drilling controller 412 may use information from sensors 420 and/or other information obtained about the operation of the drilling system 400 to more effectively operate the drilling system 400, and more reliably and safely achieve a borehole 422 that extends into a magma reservoir 214. In some cases, for example, the controller 412 may use information from sensors 420 to automatically adjust parameters of a drilling operation. For example, if borehole characteristics indicated by data from sensors 420, such as weight on drill bit 410 and/or torque on drill bit 410, indicate a transition zone has been reached, drilling parameters may be adjusted to drill through the transition zone (e.g., by decreasing drilling rate, providing additional drilling fluid, etc.). Similarly, if the borehole 422 characteristics and/or drilling characteristics indicate a magma reservoir 214 has been reached, drilling parameters may be adjusted to drill through magma in the magma reservoir 214 (e.g., by decreasing drilling rate, providing additional drilling fluid, reciprocating the drill bit, and/or taking other actions to form a drillable rock plug in the magma reservoir 214). In some cases, rather than (or in addition to) automatically implementing the improved drilling parameters, the controller 412 may present suggested drilling parameters for operators of the drilling equipment to perform or consider performing. In some cases, the controller 412 presents data obtained from the sensors 420 and may optionally present alerts when an alternate drilling mode should be considered, such as to adjust operating parameters to successfully drill through a transition zone or magma reservoir 214.

Example Magma Drilling Process

In the subsections below, an example process for drilling into a magma reservoir 214 is described. FIGS. 5A-5F illustrate example wellbores 500*a-f* at various stages of this drilling process. The example process illustrated in FIGS. 5A-5F is described as being performed using the drilling system 400 of FIG. 4. However, any other suitable drilling system can be used (e.g., with the same or a similar drilling controller 412 to that described above with respect to FIG. 4).

Establishing Initial and Intermediate Casings

Prior to establishing the drilling system 400 at the drill site, the drill site may be prepared as needed with a foundation to support the weight of the components of the drilling system 400. For example, the land may be graded and leveled as needed, and the conductor 502 for the well may be set in the ground. The drilling system 400 is then established at the drill site.

Figure 5A:
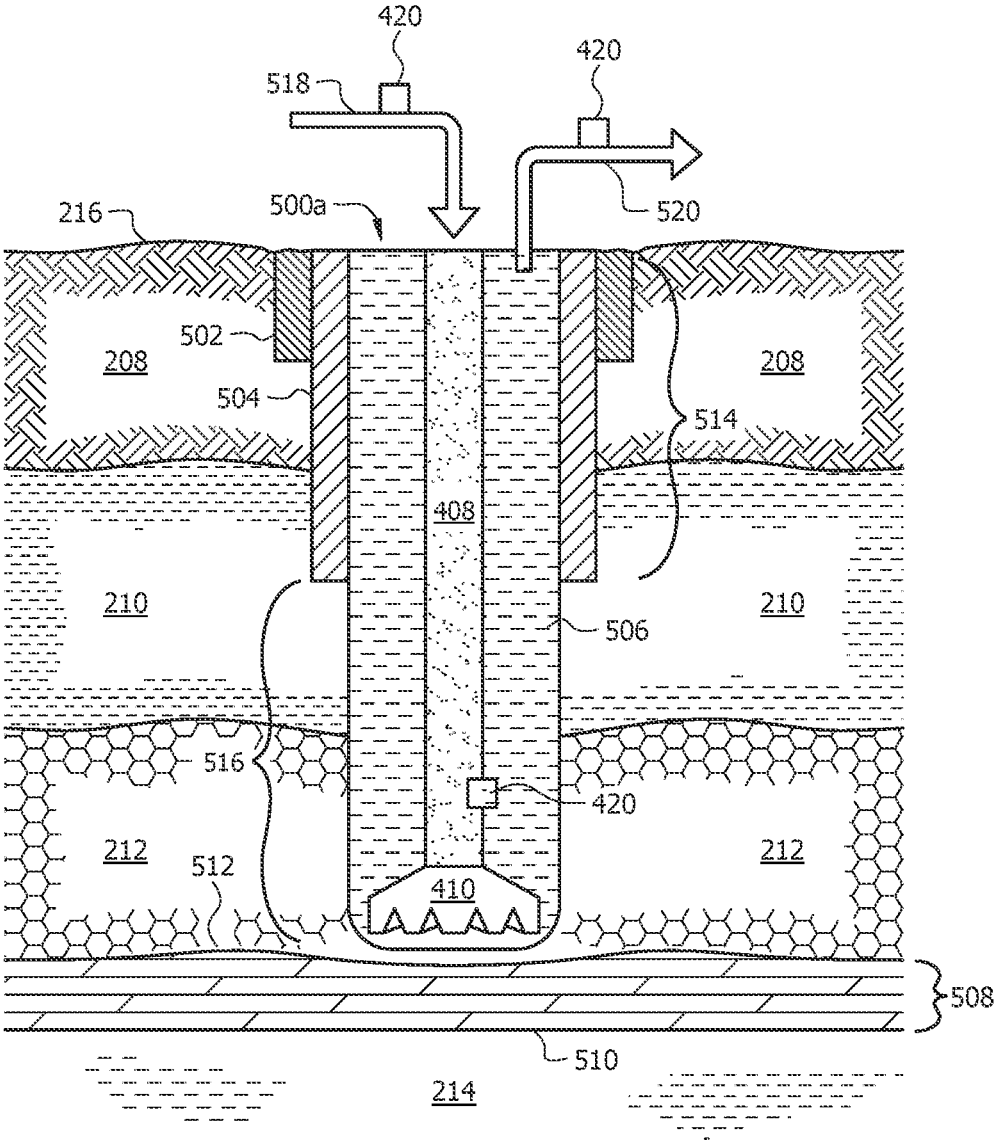
FIGS. 5A-5F are diagrams illustrating various stages of drilling a wellbore using the drilling system of FIG. 4.

FIG. 5A illustrates an example wellbore 500*a* prepared with an initial casing 504. In the example of FIG. 5A, the wellbore 500*a* extends nearly to the onset of a transition zone 508 between rock layers 208, 210, 212 and magma in the magma reservoir 214. The transition zone 508 extends from a starting depth 512 (e.g., a depth at which rock becomes more ductile due to the heat from the magma reservoir 214) to the ceiling 510 of the magma reservoir 214.

To obtain the wellbore 500*a* of FIG. 5A, a shallow hole with a relatively wide diameter may be drilled to a shallow depth to establish the conductor 502. The conductor 502 provides structural support to the wellbore 500*a*. A subsequent borehole section 514 is then drilled with a smaller diameter to establish an initial casing 504. For example, a drilling fluid 506 may be circulated through the borehole, and the borehole may be conditioned prior to pulling out the bottom hole assembly 408 and running casing operations to establish the initial casing 504. The initial casing 504 may be put in place by flowing cement along with walls of the borehole drilled in section 514. The cement is allowed to set to secure the casing 504 inside the wellbore 500*a*. The initial casing 504 may be a metal or alloy casing. The cement used to secure the initial casing 504 may be formed of Portland cement or the like.

Prior to drilling the next section 516 of the borehole (shown as an uncased borehole region in FIG. 5A), the wellbore 500*a* may be tested (e.g., to test the structural integrity of the initial casing 504). Once the initial casing 504 is established and tested, the next section 516 of the borehole is drilled. For example, the casing equipment may be removed, and the wellbore 500*a* may be conditioned. Section 516 may be drilled with a smaller diameter drill bit 410. Section 516 may be drilled to a predetermined depth or until other properties are achieved. For example, drilling may proceed until certain bottom hole conditions are detected. For instance, drilling may proceed until a bottom hole temperature (e.g., measured by a sensor 420) is greater than 100° C. while not exceeding temperature limitations of the tools and equipment used to prepare the wellbore 500*a*. In some cases, section 516 may be drilled until entry into the transition zone 508 is detected (see corresponding subsection below).

During operations to drill through section 514 and 516 (as described above), the wellbore 500*a* may be filled with drilling fluid 506. As an example, the drilling fluid 506 may be a mixture of water with other components to adjust its viscosity. Drilling fluid 506 is sometime referred to as "mud." The drilling fluid 506, in one example, may be a water-based mud with a density corresponding to a specific gravity of about one. The drilling fluid 506 may be flowed through the wellbore 500*a* through inlet conduit 518 and outlet conduit 520. Inlet conduit 518 facilitates flow of drilling fluid 506 down the drill string of the bottom hole assembly 408 and out through the drill bit 410 and/or openings in the drill string. The outlet conduit 520 facilitates return of the drilling fluid 506 from the wellbore 500*a* to other components of the drilling system 400 (e.g., to the drilling fluid tank 414). In some cases, the direction of flow may be reversed, such that drilling fluid 506 is provided downwards through the wellbore 500*a* and back to the surface 216 through the drill string.

The conduits 518, 520 may include sensors 420 for measuring properties of the drilling fluid 506 that flows therethrough. The conduits 518, 520 correspond to a portion of the fluid conduits 426 of FIG. 4, described above. For example, sensors 420 may measure the temperature of the drilling fluid 506 or the like. In the example of FIG. 5A, a sensor 420 is also coupled to the bottom hole assembly 408 to measure properties in the wellbore 500*a*. For example, the sensor 420 attached to the bottom hole assembly 408 may measure a temperature in the wellbore 500*a*.

Detecting Entry into the Rock-Magma Transition Zone

Figure 5B:
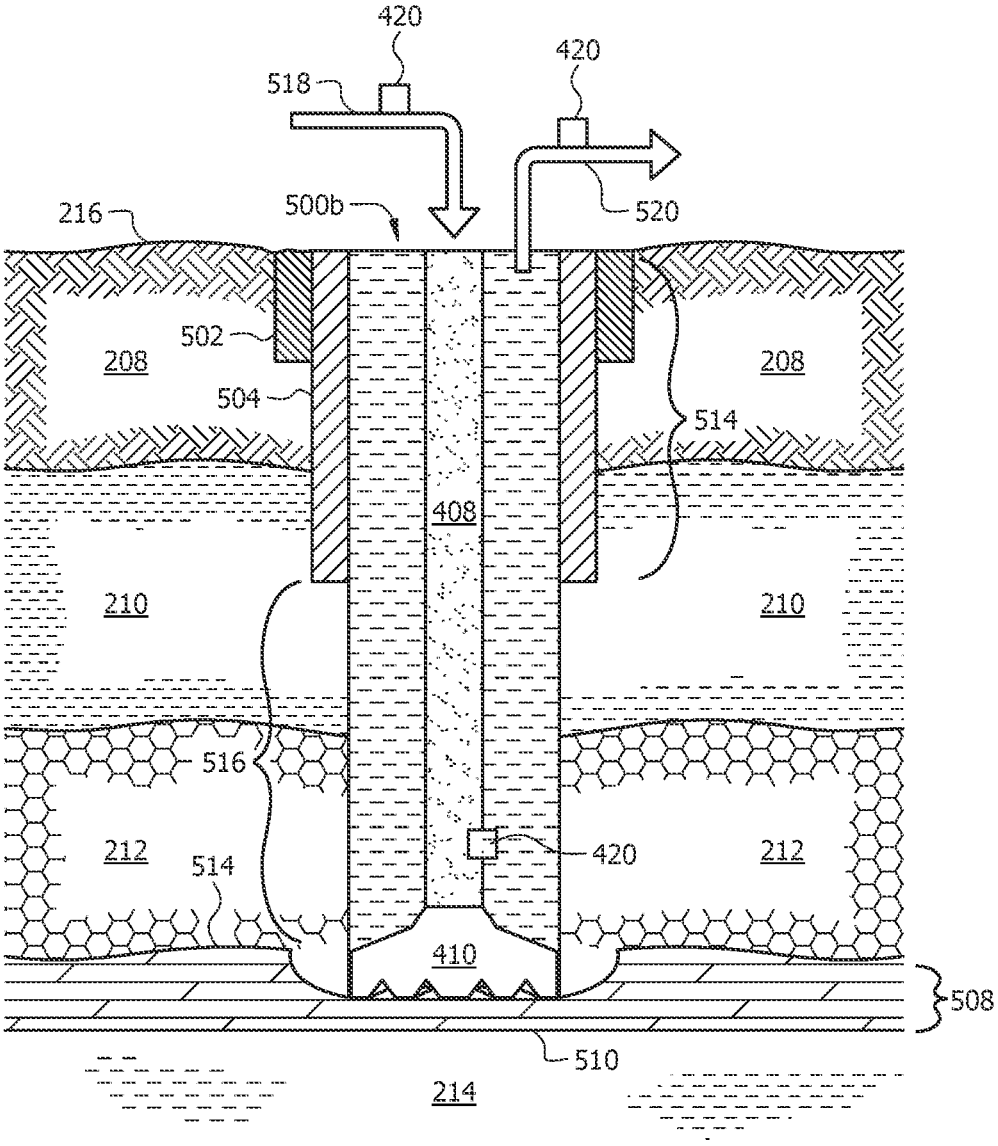

FIG. 5B illustrates a wellbore 500*b* after additional drilling has been performed after establishing the initial casing 504. In the example of FIG. 5B, the drill bit 410 is beginning to enter the transition zone 508. The transition zone 508 is an intermediate region between the solid rock of layer 212 and the liquid magma of magma reservoir 214. The transition zone 508 is a ductile rock layer adjacent (e.g., above) the magma reservoir 214. Prior to this disclosure there were no established methods or systems for detecting entrance of a drill bit into the transition zone 508 leading into a magma reservoir 214. As such, this disclosure facilitates a range of drilling improvements in such environments. For example, if the aim is to drill into the magma reservoir 214, as described in this disclosure, drilling operations can be adjusted to facilitate successful drilling through both the transition zone 508 and the magma reservoir 214. Alternatively, if drilling into a magma reservoir 214 is not desired, as is the case for previous conventional drilling technology, the systems and methods of this disclosure can be used to detect entrance into a transition zone 508 and appropriately halt drilling to avoid contact with magma in a magma reservoir 214.

Referring again to the drilling system 400 of FIG. 4, the drilling controller 412 may use information from various sensors 420 and/or data obtained from other drilling components to detect entrance into the transition zone 508. For example, drilling characteristics (e.g., drilling characteristics 908 of FIG. 9) may be monitored that are associated with various components of drilling equipment used to drill the wellbore 500*b*. Characteristics of the wellbore 500*b* (e.g., borehole characteristics 916 of FIG. 9) being drilled may also be monitored. Entry of the drill bit 410 into the transition zone 508 may be detected based at least in part on the monitored drilling and/or borehole characteristics.

As an example, a monitored drilling characteristic may be the torque of the drill bit 410 during drilling. An increased torque may indicate entry of the drill bit 410 into the transition zone 508. For example, torque may increase upon the drill bit 410 exiting the solid rock of layer 212 and beginning to contact the ductile rock of the transition zone 508. For example, if the torque increases above a predefined threshold value associated with the transition zone 508 or increases by at least a threshold amount, then the drilling controller 412 and/or an operator of the drilling system 400 may determine that the transition zone 508 has been reached. In some cases, entry into the transition zone 508 is detected if the torque increases by a predefined percentage from an initial or default value (e.g., a torque value associated with drilling through solid rock). In other cases, entry into the transition zone 508 is detected if the rate of change of the torque over time exceeds a threshold value (e.g., if a sudden, rapid increase in torque is detected). In some cases, depending on the characteristics of the Earth in the region being drilled, a decrease in torque (or its rate of change) may indicate entry of the drill bit 410 into the transition zone 508.

As another example, a monitored drilling characteristic may be the weight on the drill bit 410 used for drilling. A decrease in the weight on the drill bit 410 may indicate entry into the transition zone 508. For example, the weight on the drill bit 410 may be relatively high to penetrate the solid rock of layer 212, but this weight may decrease relatively abruptly upon entering the transition zone 508. For example, if the weight on the drill bit 410 decreases below a predefined threshold value associated with the transition zone 508, then the drilling controller 412 and/or an operator of the drilling system 400 may determine that the transition zone 508 has been reached. In some cases, entry into the transition zone 508 is detected if the weight on the drill bit 410 decreases by a predefined percentage from an initial or default value (e.g., a weight associated with drilling through solid rock). In other cases, entry into the transition zone 508 is detected if the rate of change of the weight on the drill bit 410 over time exceeds a threshold value (e.g., if a sudden, rapid decrease in weight on the drill bit 410 is detected). In some cases, depending on the characteristics of the Earth in the region being drilled, an increase in weight on the bit (or its rate of change) may indicate entry of the drill bit 410 into the transition zone 508.

As another example, a monitored drilling characteristic may be the pressure of the pump 424 used to provide drilling fluid 506 during drilling. A change (e.g., an increase) in the pump pressure may indicate entry into the transition zone 508. For example, pump pressure may increase when providing fluid to the relatively ductile rock of the transition zone 508. If the pump pressure changes by more than a threshold amount or increases above a predefined threshold value associated with the transition zone 508, then the drilling controller 412 and/or an operator of the drilling system 400 may determine that the transition zone 508 has been reached. In some cases, entry into the transition zone 508 is detected if the pump pressure increases by a predefined percentage from an initial or default value (e.g., a pressure associated with providing drilling fluid to solid rock). In other cases, entry into the transition zone 508 is detected if the rate of change of the pump pressure over time exceeds a threshold value (e.g., if a sudden, rapid increase in pump pressure is detected).

The monitored borehole properties may include properties of cuttings returned to the surface during drilling. One or more sensors 420 and/or the sampling device 418 may be used to measure properties of the cuttings. For example, the shape of the cuttings may change from sheared rock to pellet shaped platelets upon entering the transition zone 508. For example, if values associated with the shape, color, texture, or the like of the cuttings are within a range of values associated with the transition zone 508, then the drilling controller 412 and/or an operator of the drilling system 400 may determine that the transition zone 508 has been reached. As an example, an image analysis algorithm may determine whether the cuttings are similar in shape to those known to be obtained from a transition zone 508. If the similarity is above a threshold value, the controller 412 and/or operator may determine that the transition zone 508 has been reached.

As another example, the monitored borehole characteristics may include an amount of one or more gaseous species returned from the borehole. An increase and/or decrease in the amount of certain gaseous species returned from the wellbore 500*b* may indicate entry into the transition zone 508. For example, hydrogen sulfide gas, sulfate gases, chlorinated gases, fluorine gas, and/or helium gas may be released upon drilling into the transition zone 508. If the amount of one or more of these gaseous species exceeds a threshold value, then the drilling controller 412 and/or an operator of the drilling system 400 may determine that the transition zone 508 has been reached. In some cases, entry into the transition zone 508 is detected if the gas amount increases by a predefined percentage from an initial or default value (e.g., a concentration typically released when drilling through solid rock). In other cases, entry into the transition zone 508 is detected if the gas concentration over time exceeds a threshold value (e.g., if a sudden, rapid increase in concentration is detected). In some cases, rather than measuring amount, the presence of a certain gas may be used to indicate entry into the transition zone 508.

As yet another example, the monitored borehole characteristics may include chemical properties of the drilling fluid returned from the wellbore 500*b*. For example, chemical components of the drilling fluid may be indicative of entry into the transition zone 508 (e.g., because the chemical components are released during drilling in the transition zone 508). Sensors 420 may include sensors for measuring the presence and/or amount of these components.

As a further example, the monitored borehole characteristics may include one or more temperatures associated with the drilling process, such as temperature of drilling fluid 506 sent to the wellbore 500*b*, temperature of drilling fluid 506 returned from the wellbore 500*b*, and/or a downhole temperature. Temperatures may be measured by sensors 420, as described above. For instance, a sensor 420 may measure a temperature of relatively cool drilling fluid 506 provided to the wellbore 500*b* (e.g., in conduit 518), while another sensor 420 measures a temperature of heated drilling fluid 506 received from the wellbore 500*b* (e.g., in conduit 520). The difference between these temperatures may correspond to the amount of heating taking place in the wellbore 500*b*. Entry into the transition zone 508 may be detected when this temperature difference reaches a threshold value or rapidly increases by a threshold amount (or at a threshold rate). Similarly, a sensor 420 may be located within the wellbore 500*b* (see example sensor 420 attached to bottom hole assembly 408 in FIG. 5B). A downhole temperature measured by this sensor 420 may provide temperature information for detecting entry into the transition zone 508. For instance, entry into the transition zone 508 may be detected when the downhole temperature reaches a threshold value or rapidly increases by a threshold amount (or at a threshold rate).

As still a further example, the monitored borehole characteristics may include vibrational or acoustic characteristics of the region associated with the wellbore 500*b*. For example, a sensor 420 may be a vibrational or acoustic sensor capable of detecting vibrations within the Earth. Vibrational or acoustic data indicating vibrations indicative of a drill bit 410 drilling into the transition zone 508 may be established (e.g., using testing and/or modeling) and used to aid in detecting entry into the transition zone 508. For example, a pattern of vibrations (e.g., amplitude and/or frequency of vibrations) may be determined that are associated with the drill bit 410 entering the transition zone 508, and when the same or a similar pattern is observed, entry into the transition zone 508 may be detected.

A single or multiple drilling characteristics may be used to detect entry into the transition zone 508. For example, in some cases, entry into the transition zone 508 may only be determined if both an increase in torque and a decrease in weight on the drill bit 410 are detected. The drilling characteristics may be used alone or in combination with one or more borehole characteristics, as illustrated by various examples described in this disclosure. While this disclosure describes certain example combinations of drilling characteristics and borehole characteristics being used to detect entry into the transition zone 508, it should be understood that other combinations may be used. Furthermore, alternate and/or additional drilling characteristics and borehole characteristics may be monitored to detect entry into the transition zone 508.

When entry into the transition zone 508 is detected, the drilling system 400 may be operated according to a specially configured transition zone drilling mode. For example, during operation in the transition zone drilling mode, drilling may be performed at a decreased drilling rate. For example, the drilling rate may be a percentage (e.g., 50% or less, 10% or less, etc.) of a default drilling rate used to drill solid rock. In some cases, a thermally resistant drilling fluid 506 may be provided into the wellbore 500*b* to aid in drilling in the higher temperature conditions of the transition zone 508. The thermally resistant drilling fluid 506 may be a water-based mud with a density corresponding to a specific gravity of about two.

Figure 5C:
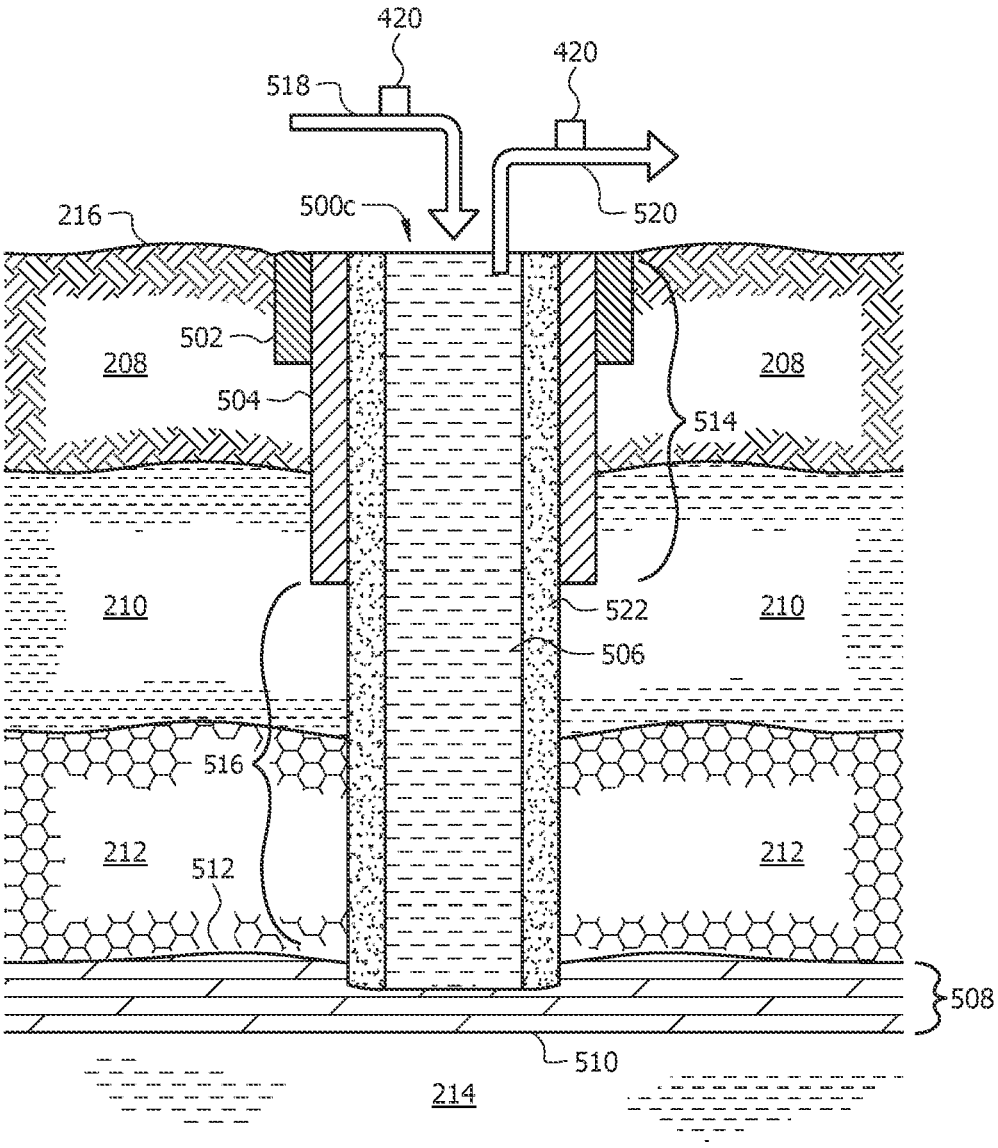

FIG. 5C shows the wellbore 500*c* with an intermediate casing 522 established in section 516 of the borehole. The intermediate casing 522 may be prepared by pulling out the bottom hole assembly 408 and conditioning the borehole (e.g., by flow of an appropriate drilling fluid 506, or other fluid, for a period of time). In some cases, the drilling fluid 506 may have a composition with an increased temperature stability, because of the increased temperatures nearer the magma reservoir 214. The intermediate casing 522 may be established similarly to the initial casing 504, described with respect to FIG. 5A. For example, cement may be flowed down the wellbore 500*c* and allowed to set to secure the intermediate casing 522 in place. The cement used to secure the intermediate casing 522 may be the same as or different than the cement used to prepare the initial casing 504. The intermediate casing 522 may be made of the same material as the initial casing 504 or a different material (e.g., a different metal or alloy). In some cases, the cement used to establish the intermediate casing 522 may have an increased temperature stability compared to the cement used to prepare the initial casing 504. For instance, the cement for the intermediate casing 522 may be a temperature-resistant cement. The intermediate casing 522 may be prepared of a material with a relatively high thermal conductivity compared to that of conventional Portland cement, such that heat can be more effectively transferred to the wellbore 500*c* through the casing 522. The intermediate casing 522 may be run with centralizers (e.g., bow-spring centralizers) per a centralization program to establish a centered intermediate casing 522. Testing may be performed as described above to confirm the structural integrity of the intermediate casing 522. While the example wellbore 500*c* has two casings 504, 522, the wellbore 500*c* could include fewer or additional casings if appropriate to maintain its structural integrity.

Detecting Entry into Magma Reservoir

Figure 5D:
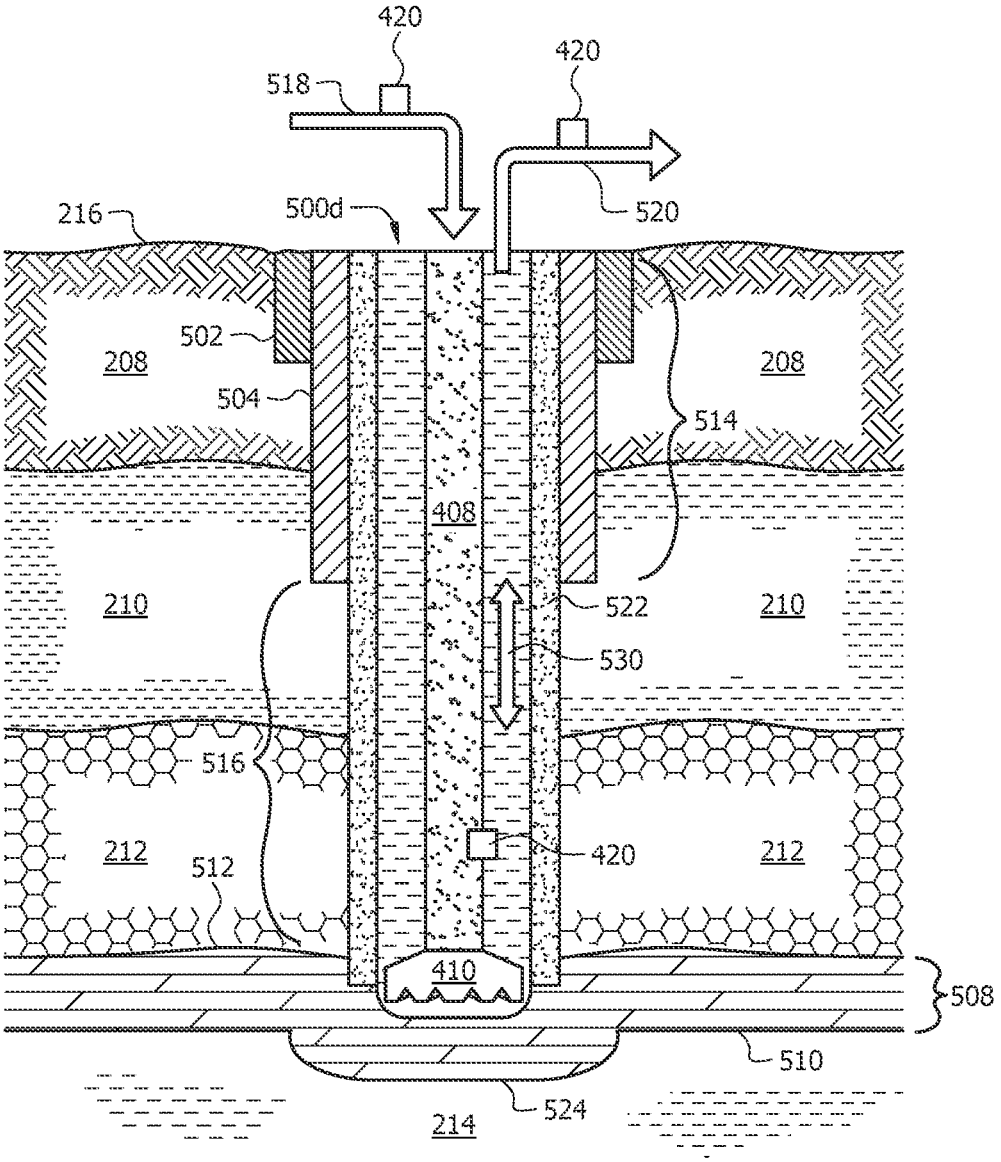

FIG. 5D shows an example wellbore 500*d* after drilling through the transition zone 508 and establishing the intermediate casing 522 of FIG. 5C. After drilling through the transition zone 508 and establishing the intermediate casing 522, the drill bit 410 may initially contact magma in the magma reservoir 214. This condition needs to be detected rapidly, such that actions can be taken to successfully drill through the magma, while preventing or limiting contact with liquid magma. Prior to this disclosure, there was a lack of reliable systems and methods for rapidly detecting entrance into a magma reservoir 214. Instead, since contact with magma was generally avoided, any incidental contact with magma was only determined after failure of the conventional drilling system and through subsequent inspection of the failed drilling components (e.g., due to the high temperature and corrosive environment of the magma reservoir 214). This disclosure provides an approach to rapidly and reliably detecting contact between the drill bit 410 and magma in the magma reservoir 214. This information allows the drilling process to be proactively adjusted (e.g., by operating under the magma drilling mode described below) to achieve the wellbore 500*d* that extends into the magma reservoir 214.

Referring to the drilling system 400 of FIG. 4, the drilling controller 412 may use information from various sensors 420 and/or data obtained from other drilling components to detect entrance into the magma reservoir 214. For example, drilling characteristics (e.g., drilling characteristics 908 of FIG. 9) may be monitored that are associated with various components of drilling equipment used to drill the wellbore 500*d*. Characteristics of the wellbore 500*d* (e.g., borehole characteristics 916 of FIG. 9) being drilled may also be monitored. Entry of the drill bit 410 into the magma reservoir 214 may be detected based at least in part on the monitored drilling and/or borehole characteristics (e.g., similarly to the detection of entry into transition zone 508, as described above with respect to FIG. 5B).

As an example, a monitored drilling characteristic may be the torque of the drill bit 410 during drilling. An increased torque may indicate entry of the drill bit 410 into the magma reservoir 214. For example, torque may increase upon the drill bit 410 exiting the ductile albeit mostly solid rock of the transition zone 508 and beginning to contact liquid magma in the magma reservoir 214. For example, if the torque increases above a predefined threshold value associated with the magma reservoir 214, then the drilling controller 412 and/or an operator of the drilling system 400 may determine that the magma reservoir 214 has been reached. In some cases, entry into the magma reservoir 214 is detected if the torque increases by a predefined percentage from an initial or default value (e.g., a torque value associated with drilling through the ductile rock of the transition zone 508). In other cases, entry into the magma reservoir 214 is detected if the rate of change of the torque over time exceeds a threshold value (e.g., if a sudden, rapid increase in torque is detected). In some cases, depending on the characteristics of the Earth in the region being drilled, a decrease in torque (or its rate of change) may indicate entry of the drill bit 410 into the magma reservoir 214.

As another example, a monitored drilling characteristic may be the weight on the drill bit 410 used for drilling. A decrease in the weight on the drill bit 410 may indicate entry into magma in the magma reservoir 214. For example, the weight on the drill bit 410 may still be relatively high to penetrate the ductile rock of the transition zone 508, but this weight may decrease abruptly upon entering the magma reservoir 214. For example, if the weight on the drill bit 410 decreases below a predefined threshold value associated with the magma reservoir 214 (e.g., less than that of the transition zone 508), then the drilling controller 412 and/or an operator of the drilling system 400 may determine that the magma reservoir 214 has been reached. In some cases, entry into the magma reservoir 214 is detected if the weight on the drill bit 410 decreases by a predefined percentage from an initial or default value (e.g., a weight associated with drilling through ductile rock in the transition zone 508). In other cases, entry into the magma reservoir 214 is detected if the rate of change of the weight on the drill bit 410 over time exceeds a threshold value (e.g., if a sudden, rapid decrease in weight on the drill bit 410 is detected). In some cases, depending on the characteristics of the Earth in the region being drilled, an increase in weight on the bit (or its rate of change) may indicate entry of the drill bit 410 into the magma reservoir 214.

As another example, a monitored drilling characteristic may be the pressure of the pump 424 used to provide drilling fluid 506 during drilling. A change in the pump pressure may indicate entry into the magma reservoir 214. For example, pump pressure may increase when providing fluid to the liquid magma in the magma reservoir 214 (e.g., because of clogging of fluid ports). In some cases, pressure may increase because of losses of drilling fluid due to evaporation in contact with the magma reservoir 214. If the pump pressure changes by more than a threshold amount or increases above a predefined threshold value associated with the magma reservoir 214, then the drilling controller 412 and/or an operator of the drilling system 400 may determine that the magma reservoir 214 has been reached. In some cases, entry into the magma reservoir 214 is detected if the pump pressure increases by a predefined percentage from an initial or default value (e.g., a pressure associated with providing drilling fluid 506 to ductile rock of the transition zone 508). In other cases, entry into the magma reservoir 214 is detected if the rate of change of the pump pressure over time exceeds a threshold value (e.g., if a sudden, rapid increase in pump pressure is detected).

The monitored borehole properties may include properties of cuttings returned to the surface during drilling. One or more sensors 420 and/or the sampling device 418 may be used to measure properties of the cuttings. For example, the shape of the cuttings may change to match that of solidified magma (e.g., obsidian) that is returned from the magma reservoir 214. For example, if values associated with the shape, color, texture, or the like of the cuttings are within a range of values associated with the magma reservoir 214, then the drilling controller 412 and/or an operator of the drilling system 400 may determine that the magma reservoir 214 has been reached. As an example, an image analysis algorithm may determine whether the cuttings are similar in shape and/or color of obsidian or another form of solidified magma. For instance, obsidian returned in from the wellbore 500*d* may have relatively sharp edges and a characteristic color. Spectroscopic analysis may be used to identify the composition of the cuttings (e.g., a sensor 420 and/or a component of the sampling device 418 may facilitate such analysis). If the similarity is above a threshold value, the controller 412 and/or operator may determine that the magma reservoir 214 has been reached.

As another example, the monitored borehole characteristics may include an amount of one or more gaseous species returned from the borehole. An increase and/or decrease in the amount of certain gaseous species returned from the wellbore 500*d* may indicate entry into the magma reservoir 214. For example, hydrogen sulfide gas, sulfate gases, chlorinated gases, fluorine gas, and/or helium gas may be released upon drilling into the magma reservoir 214 and exposing magma. If the amount of one or more of these gaseous species exceeds a threshold value, then the drilling controller 412 and/or an operator of the drilling system 400 may determine that the magma reservoir 214 has been reached. In some cases, entry into the magma reservoir 214 is detected if the gas amount increases by a predefined percentage from an initial or default value (e.g., a concentration typically released when drilling through the ductile albeit solid rock of the transition zone 508). In other cases, entry into the magma reservoir 214 is detected if the gas concentration over time exceeds a threshold value (e.g., if a sudden, rapid increase in concentration is detected). In some cases, rather than measuring amount, the presence of a certain gas, such as hydrogen sulfide, which is characteristically released by magma under most conditions may be used to indicate entry into the magma reservoir 214.

As yet another example, the monitored borehole characteristics may include chemical properties of the drilling fluid returned from the wellbore 500*d*. For example, chemical components of the drilling fluid may be indicative of entry into the magma reservoir 214 (e.g., because the chemical components are transferred to the drilling fluid 506 during contact with magma in the magma reservoir 214). Sensors 420 may include sensors for measuring the presence and/or amount of these components.

As a further example, the monitored borehole characteristics may include one or more temperatures associated with the drilling process, such as temperature of drilling fluid sent 506 to the wellbore 500*d*, temperature of drilling fluid 506 returned from the wellbore 500*d*, and/or a downhole temperature. Temperatures may be measured by sensors 420, as described above. For instance, as described above with respect to FIG. 5B, a sensor 420 may measure a temperature of relatively cool drilling fluid 506 provided to the wellbore 500*d* (e.g., in conduit 518), while another sensor 420 measures a temperature of heated drilling fluid 506 received from the wellbore 500*d* (e.g., in conduit 520). The difference between these temperatures may correspond to the amount of heating taking place in the wellbore 500*d*. Entry into the magma reservoir 214 may be detected when this temperature difference reaches a threshold value or rapidly increases by a threshold amount (or at a threshold rate). Similarly, a sensor 420 may be located within the wellbore 500*d* (see example sensor 420 attached to bottom hole assembly 408 in FIG. 5D). A downhole temperature measured by this sensor 420 may provide temperature information for detecting entry into the magma reservoir 214. For instance, entry into the magma reservoir 214 may be detected when the downhole temperature reaches a threshold value or rapidly increases by a threshold amount (or at a threshold rate). A rapid increase in downhole temperature is characteristic of reaching the magma reservoir 214.

As still a further example, the monitored borehole characteristics may include vibrational or acoustic characteristics of the region associated with the wellbore 500*d*, similarly to as described above with respect to FIG. 5B. For example, a sensor 420 may be a vibrational or acoustic sensor capable of detecting vibrations within the Earth. Vibrational or acoustic data indicating vibrations indicative of a drill bit 410 drilling into the magma reservoir 214 may be established (e.g., via testing and/or modeling) and used to aid in detecting entry into the magma reservoir 214. For example, a pattern of vibrations (e.g., amplitude and/or frequency of vibrations) may be determined that are associated with the drill bit 410 entering the magma reservoir 214, and when the same or a similar pattern is observed, entry into the magma reservoir 214 may be detected.

A single or multiple drilling characteristics may be used to detect entry into the magma reservoir 214. For example, in some cases, entry into the magma reservoir 214 may only be determined if both an increase in torque and an increase in temperature is detected. The drilling characteristics may be used alone or in combination with one or more borehole characteristics, as illustrated by various examples described in this disclosure. In some cases, borehole characteristics alone may be used to detect entry into the magma reservoir 214. While this disclosure describes certain example combinations of drilling characteristics and borehole characteristics being used to detect entry into the magma reservoir 214, it should be understood that other combinations may be used. Furthermore, alternate and/or additional drilling characteristics and borehole characteristics may be monitored to detect entry into the magma reservoir 214.

Drilling in Magma Reservoir

Once entry into the magma reservoir 214 is detected, a specially configured magma drilling mode or strategy may be used to successfully drill to a target depth (e.g., depth 558 of FIG. 5E) within the magma reservoir 214. Drilling into magma has generally only previously been performed unintentionally and with limited success. As described above, unintentional drilling into magma did not reach considerable depths because drilling equipment would fail rapidly. For example, the bottom hole assembly 408 may become stuck in the magma, components may be damaged due to high temperature and corrosivity of magma, and the like.

The unique magma mode of operation provided by this disclosure may facilitate safe and reliable drilling into a magma reservoir 214. As illustrated in FIG. 5D, drilling into the magma reservoir 214 involves formation of a rock plug 524 along with a reciprocating movement (illustrated by double-sided arrow 530 of FIG. 5D), which aids in preventing sticking of the drill bit 410 in the liquid magma. Drilling may be performed at a decreased rate, while drilling fluid 506 is provided into the wellbore 500*d* at a high rate (e.g., the maximum achievable by the pump 424 of FIG. 4). Drilling characteristics and borehole characteristics may be monitored throughout drilling in the magma reservoir 214 to tune drilling parameters.

As an example, when entry into the magma reservoir 214 is detected, the drilling system 400 may initially pull the drill bit 410 back towards the surface (e.g., back ream the wellbore 500*d*). Drilling fluid 506 is then provided at an increased rate (e.g., the maximum rate of the pump 424 of FIG. 4) in order to form a solid rock plug 524 in the magma of the magma reservoir. The solid rock plug 524 is generally solidified magma (e.g., obsidian or another form of solidified magma) that can be more readily drilled using the drill bit 410. The drill bit 410 may be pulled off-bottom then moved up and down in the reciprocating motion shown by double-sided arrow 530 to aid in the formation of the rock plug 524 and help prevent sticking of the drill bit 410. For example, the drill bit 410 may be lowered to drill at least partially through the rock plug 524 and pulled up to allow another layer of rock plug 524 to form through the cooling effect of drilling fluid 506 pumped into the wellbore 500*d*. The cooler 416 of FIG. 4 may be operated to bring the drilling fluid 506 to an appropriately low temperature for forming the rock plug 524. Managed pressure drilling may be used during drilling in the magma reservoir 214 to remain overbalanced relative to magma. Otherwise, any drilling attempted into the liquid magma (e.g., before rock plug 524 forms) will be in an underbalanced state. In some cases, a thermally resistant drilling fluid 506 may be provided into the wellbore 500*d* to aid in drilling in the higher temperature conditions of the magma reservoir 214. As an example, the temperature resistant drilling fluid may be a water-based mud, for example, with a specific gravity of about two.

In the event that an over-pressurization of the wellbore 500*d* is detected (e.g., by the drilling controller 412 receiving information from a sensor 420 that measures pressure in the wellbore 500*d*), magma from the magma reservoir 214 may begin to enter the wellbore 500*d*. In response to such conditions, the wellbore 500*d* may be closed off while fluid is circulated at a high rate before the wellbore 500*d* is depressurized. This may be performed a number of times to help stop the inflow of magma and facilitate formation of rock plug 524. After drilling in the magma reservoir 214 can again safely proceed, drilling is continued according to the process described above until a target depth is reached (see, e.g., target depth 558 of FIG. 5E, described below). If for some reason it is not possible to reach the target depth, progressively smaller diameter drill bits 410 may be used to continue drilling.

After a target depth is reached (see, e.g., target depth 558 of FIG. 5E, described below), additional steps may be performed to prepare the wellbore 500*d* to receive the boiler casing (see boiler casing 550 of FIG. 5E, described below). For example, drilling fluid 506 or another appropriate fluid may be circulated through the wellbore 500*d* for a period of time to increase the thickness and/or strength of the rock plug 524. Borehole characteristics, such as temperature of drilling fluid 506 provided into and returned from the wellbore 500*d*) may continue to be monitored to confirm that the wellbore 500*d* is stable. An increase in temperature may indicate a breach of the rock plug 524 and possible entry of magma into the wellbore 500*d*.

Placing a Boiler in the Magma Wellbore

Once the borehole characteristics are stable (e.g., changing by less than a threshold amount over time), a boiler casing is lowered into the wellbore. FIG. 5E shows an example wellbore 500*e* after the target depth 558 has been reached and a boiler casing 550 has been placed in the wellbore 500*e*. The boiler casing 550 facilitates the heating of a heat transfer fluid, such as water or another fluid, to very high temperatures via heat transfer with the magma reservoir 214. The boiler casing 550 may be made of a heat resistant material, such as a temperature resistant metal alloy, ceramic, or composite material. The boiler casing 550 is an approximately cylindrically shaped structure with an opening at a top end 566 near the surface and a closed end 568 positioned within the portion of the wellbore 500*e* that extends into the magma reservoir 214. The boiler casing 550 may be held in place at least partially by one or more liner hanger 552. The liner hanger 552 is a structural support, or latch point, for the boiler casing 550.

A return fluid conduit 556 is positioned inside the boiler casing 550. The return fluid conduit 556 facilitates the return of fluid heated in the boiler casing 550 to the surface. For example, a fluid, such as water or another appropriate heat transfer fluid, may be provided into the boiler casing 550 via an inlet conduit 562. The water or other fluid is heated as it travels from the surface toward the closed end 568 of the boiler casing 550. The water or other fluid may be heated to particularly high temperatures inside the portion of the boiler casing 550 that extends into the magma reservoir 214. This heated water or other fluid is then returned to the surface via the return fluid conduit 556 and sent from the wellbore 500*e* via an outlet conduit 564 (e.g., for use by thermal process system 304 of FIG. 3 or to be cooled by the system 800 of FIG. 8). The water or other fluid may change phases or partially change phases when heated in the boiler casing 550. The return fluid conduit 556 may be insulated to prevent heat loss of the water or other fluid sent back to the surface.

Figure 5E:
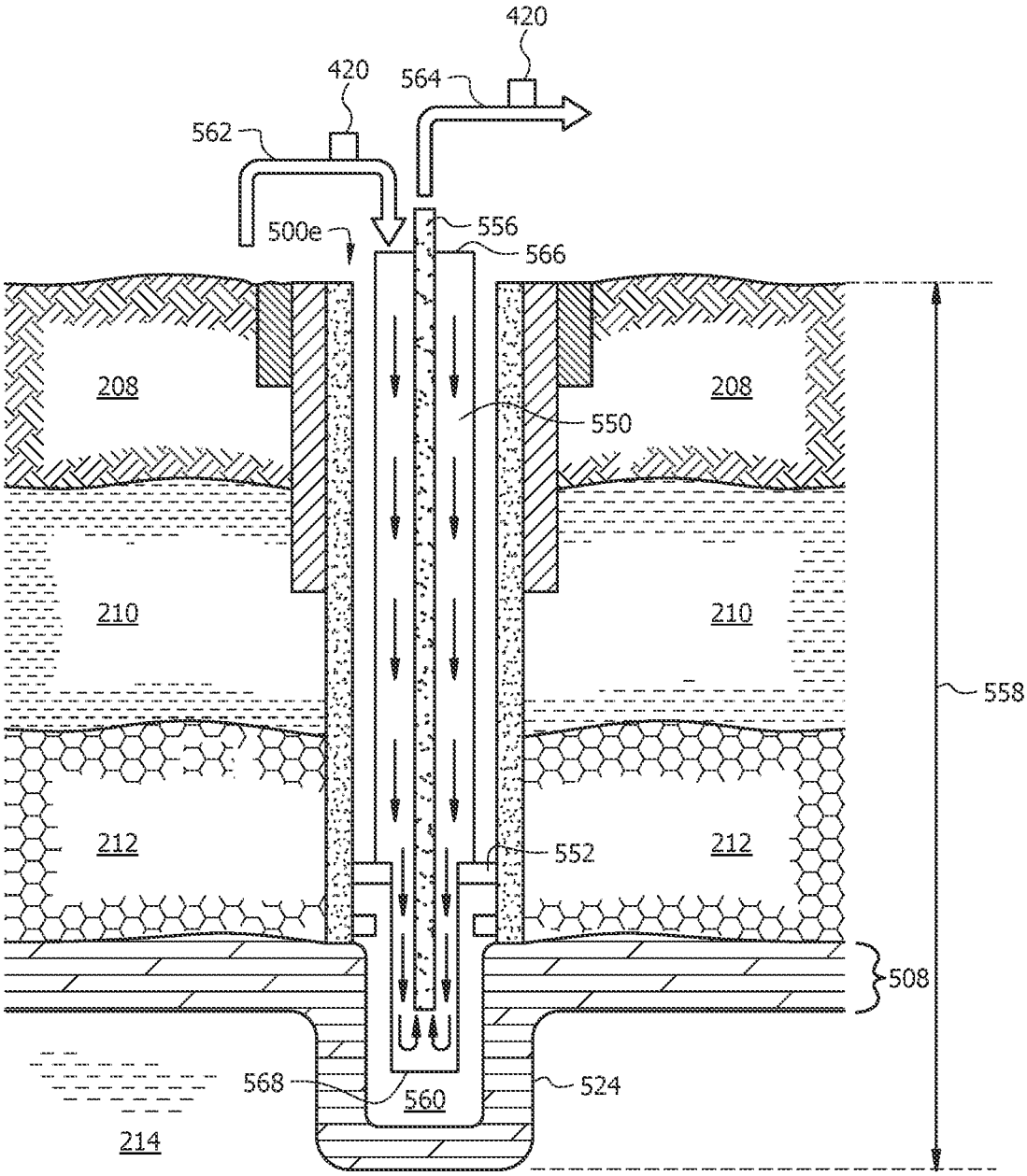
Figure 5F:
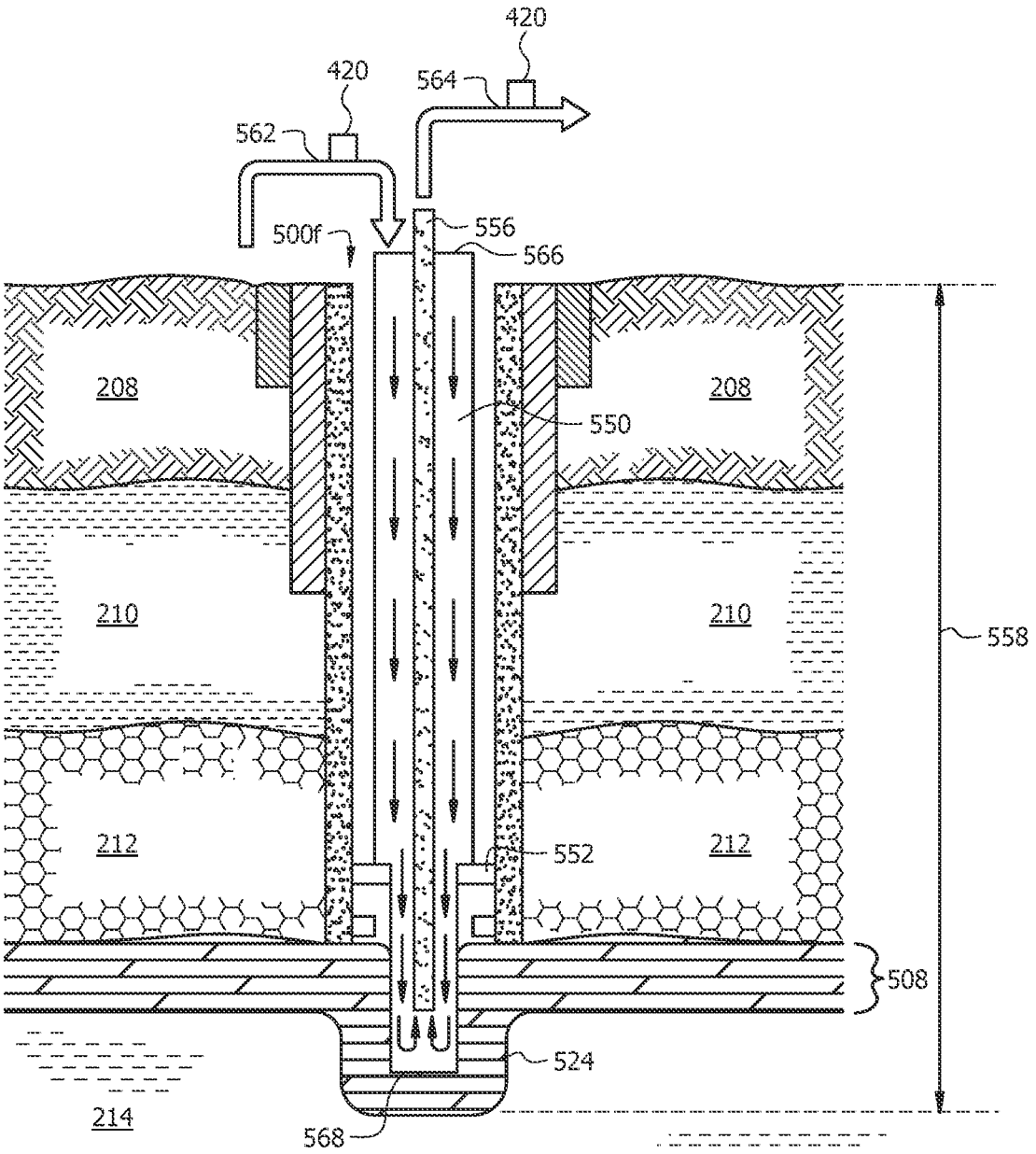

When the boiler casing 550 is initially placed in the wellbore 500*e*, there may be a physical space or gap 560 between the outer wall of the boiler casing 550 and rock plug 524 formed in the magma reservoir 214, as shown in the example of FIG. 5E. This gap 560 may decrease heat transfer between the magma reservoir 214 and the boiler casing 550. As such, in some cases, the flow of water or other fluid through the boiler casing 550 may be decreased (or stopped) for a period of time to allow the rock plug 524 to melt, and magma in the magma reservoir 214 to move closer to or into contact with the outer surface of the boiler casing 550. Water or another fluid is then supplied through the boiler casing 550 again to form a new rock plug 524 that helps protect the outer surface of the boiler casing 550 from the harsh environment of the magma reservoir 214 with fewer heat transfer losses that are associated with gap 560. An example of a final wellbore 500*f* without gap 560 (or with a decreased size gap 560) is shown in the example of FIG. 5F. The resulting wellbore 500*f* may be used as wellbore 302 of FIG. 3, described above.

Example Method of Preparing a Magma Wellbore

Figure 6:
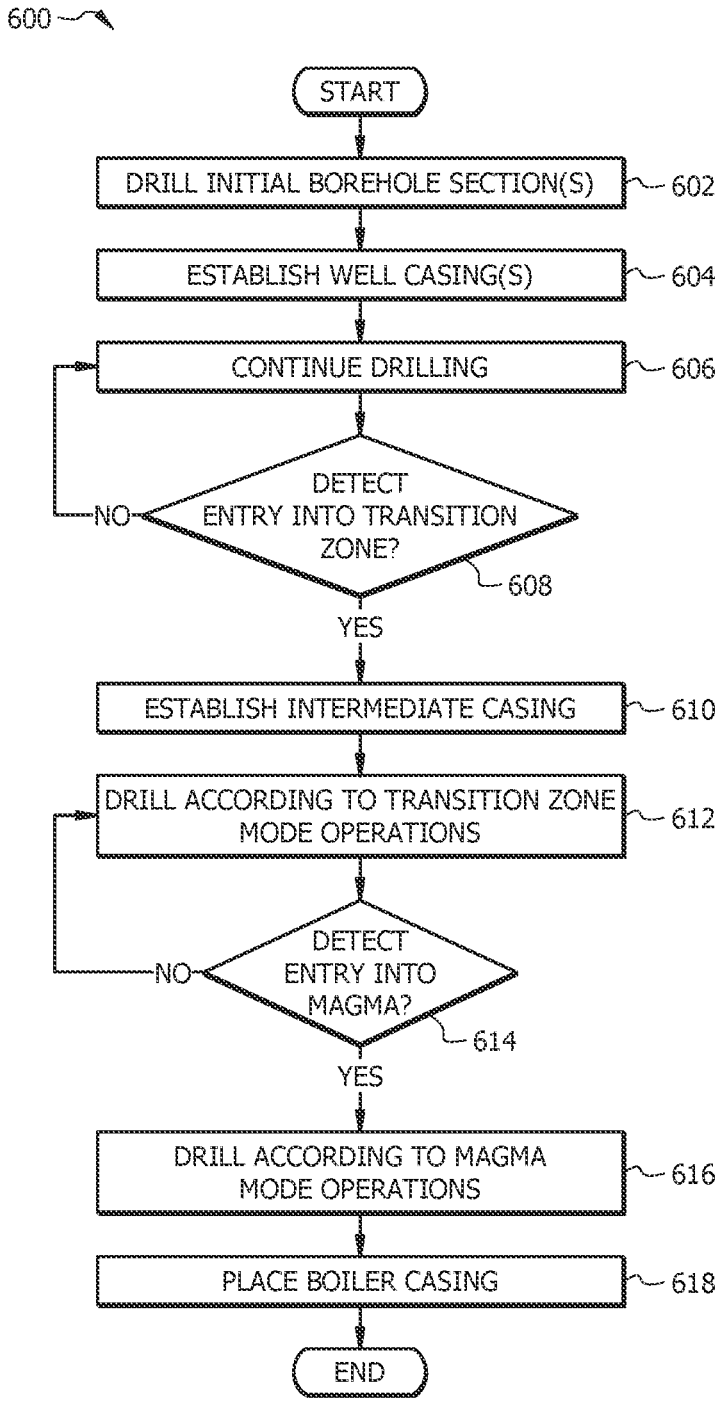
FIG. 6 is a flowchart of an example method for operating the drilling system of FIG. 4.

FIG. 6 illustrates an example method 600 of preparing a wellbore 500*f* that extends into a magma reservoir 214. The method 600 may begin at step 602 where initial borehole sections 514 and 516 are drilled into the surface of the Earth. At step 604, well casings 504 and 506 are established in the wellbore, as described above with respect to the examples of FIGS. 5A and 5B. At step 606, drilling is continued toward the transition zone 508 between solid rock layers 208, 210, 212 and the magma reservoir 214.

At step 608, a determination is made of whether the transition zone 508 has been reached, as described above (see, e.g., FIG. 5B). If the transition zone 508 has not been reached, drilling continues according to step 606. Otherwise, if the transition zone 508 has been reached, the method 600 proceeds to step 610. At step 610, the intermediate casing 522 is established (see, e.g., FIG. 5C). At step 612, the drilling system 400 is operated according to the transition zone operating mode, for example, at a decreased drilling rate and with increased flow of drilling fluid 506.

At step 614, a determination is made of whether the magma reservoir 214 has been entered, as described above (see, e.g., FIG. 5D). If the magma reservoir 214 has not been entered, drilling continues according to step 612. Otherwise, if entry into the magma reservoir 214 is detected, the method 600 proceeds to step 616. At step 616, drilling proceeds according to a magma drilling operating mode. For example, drilling may be performed at low rates with high flows of drilling fluid 506 and a reciprocating motion of the drill bit 410 (see FIG. 5D). At step 618, a boiler casing 550 is established in the wellbore, as illustrated in FIGS. 5E and 5F and described above.

Modifications, omissions, or additions may be made to method 600 depicted in FIG. 6. Method 600 may include more, fewer, or other steps. For example, at least certain steps may be performed in parallel or in any suitable order. All or a portion of the operations may be performed by or facilitated using information determined using the drilling controller 412 of FIGS. 4 and 9. Any suitable drilling equipment or associated component(s) may perform or may be used to perform one or more steps of the method 600.

Example Thermal Processing Systems

Figure 7:
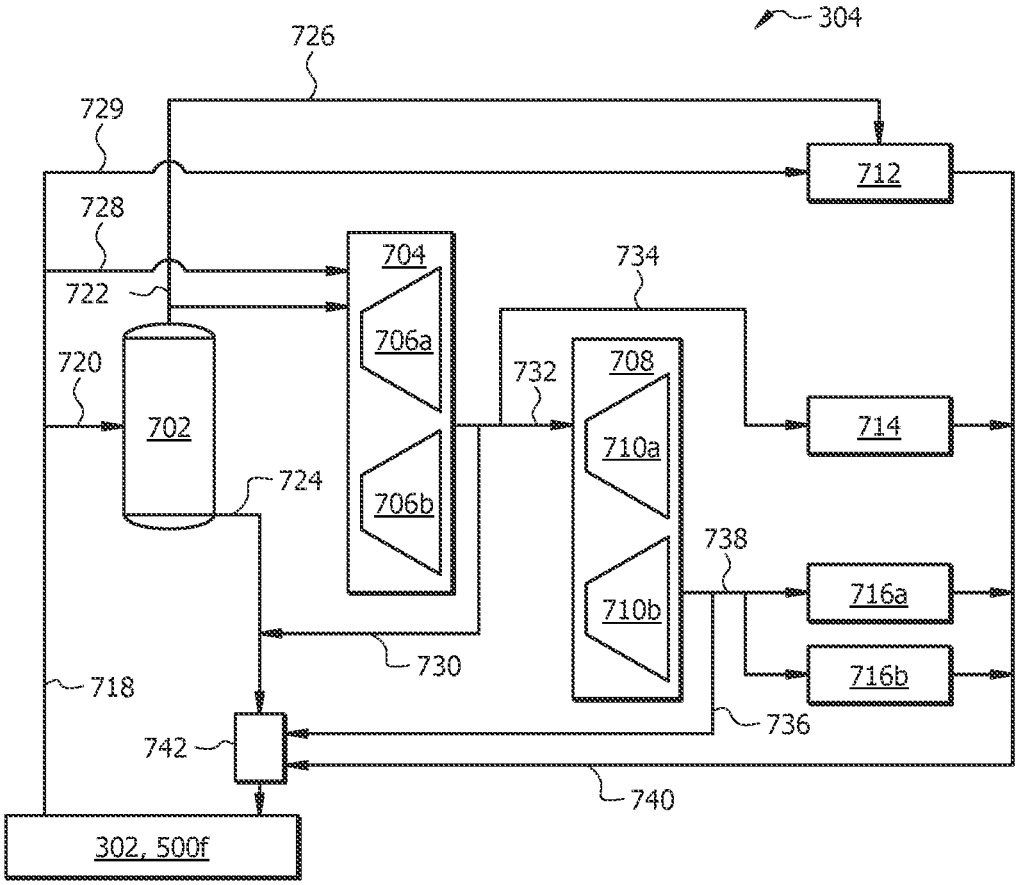
FIG. 7 is a diagram of an example system for performing thermal or heat-driven processes of FIG. 3.

FIG. 7 shows a schematic diagram of an example thermal process system 304 of FIG. 3. The thermal process system 304 includes a steam separator 702, a first turbine set 704, a second turbine set 708, a high-temperature/pressure thermochemical process 712, a medium-temperature/pressure thermochemical process 714, and one or more lower temperature/pressure processes 716*a,b*. The thermal process system 304 may include more or fewer components than are shown in the example of FIG. 7. For example, a thermal process system 304 used for power generation alone may omit the high-temperature/pressure thermochemical process 712, medium-temperature/pressure thermochemical process 714, and lower temperature/pressure processes 716*a,b*. Similarly, a thermal process system 304 that is not used for power generation may omit the turbine sets 704, 708. As a further example, if heat transfer fluid is known to be received only in the gas phase, the steam separator 702 may be omitted in some cases. The ability to tune the properties of the heat transfer fluid received from the unique wellbore 302 of FIG. 3 or 500*f* of FIG. 5F (i.e., as prepared according to the method 600 of FIG. 6 and/or the approach illustrated in FIGS. 5A-5F) facilitates improved and more flexible operation of the thermal process system 304. For example, the depth of the wellbore 302, 500*f*, the residence time of heat transfer fluid in the wellbore 302, 500*f*, the pressure achieved in the wellbore 302, 500*f*, and the like can be selected or adjusted to provide desired heat transfer fluid properties at the thermal process system 304.

In the example of FIG. 7, the thermal process system 304 receives a stream 718 from the wellbore 302, 500*f*. One or more valves (not shown for conciseness) may be used to control the allocation of stream 718 within the thermal process system 304, e.g., to a steam separator 702 via stream 720, and/or to the first turbine set 704 via stream 728, and/or to the thermal process 712 via stream 729. Thus, the entirety of stream 718 can be provided to any one of streams 720, 728, or 729, or distributed equally or unequally among streams 720, 728, and 729.

The steam separator 702 is connected to the wellbore 302, 500*f* that extends between a surface and the underground magma reservoir. The steam separator 702 separates a vapor-phase heat transfer fluid (e.g., steam) from liquid-phase heat transfer fluid (e.g., condensate formed from the vapor-phase heat transfer fluid). A stream 720 received from the wellbore 302, 500*f* may be provided to the steam separator 702. A vapor-phase stream 722 of heat transfer fluid from the steam separator 702 may be sent to the first turbine set 704 and/or the thermal process 712 via stream 726. The thermal process 712 may be a thermochemical reaction requiring high temperatures and/or pressures (e.g., temperatures of between 500° F. and 2,000° F. and/or pressures of between 1,000 psig and 4,500 psig). A liquid-phase stream 724 of heat transfer fluid from the steam separator 702 may be provided back to the wellbore 302, 500*f* and/or to condenser 742. The condenser 742 is any appropriate type of condenser capable of condensing a vapor-phase fluid. The condenser 742 may be coupled to a cooling or refrigeration unit, such as a cooling tower (not shown for conciseness).

The first turbine set 704 includes one or more turbines 706*a,b*. In the example of FIG. 7, the first turbine set includes two turbines 706*a,b*. However, the first turbine set 704 can include any appropriate number of turbines for a given need. The turbines 706*a,b* may be any known or yet to be developed turbine for electricity generation. The turbine set 704 is connected to the steam separator 702 and is configured to generate electricity from the vapor-phase heat transfer fluid (e.g., steam) received from the steam separator 702 (stream 722). A stream 730 exits the set of turbines 704. The stream 730 may be provided to the condenser 742 and then back to the wellbore 302, 500*f*.

If the heat transfer fluid is at a sufficiently high temperature, as may be uniquely and more efficiently possible using the wellbore 302, 500*f*, a stream 732 of vapor-phase heat transfer fluid may exit the first turbine set 704. Stream 732 may be provided to a second turbine set 708 to generate additional electricity. The turbines 710*a,b* of the second turbine set 708 may be the same as or similar to turbines 706*a,b*, described above.

All or a portion of stream 732 may be sent as vapor-phase stream 734 to a thermal process 714. Process 714 is generally a process requiring vapor-phase heat transfer fluid at or near the conditions of the heat transfer fluid exiting the first turbine set 704. For example, the thermal process 714 may include one or more thermochemical processes requiring steam or another heat transfer fluid at or near the temperature and pressure of stream 732 (e.g., temperatures of between 250° F. and 1,500° F. and/or pressures of between 500 psig and 2,000 psig). The second turbine set 708 may be referred to as "low pressure turbines" because they operate at a lower pressure than the first turbine set 704. Fluid from the second turbine set 708 is provided to the condenser 742 via stream 736 to be condensed and then sent back to the wellbore 302, 500*f*.

An effluent stream 738 from the second turbine set 708 may be provided to one or more thermal processes 716*a,b*. Thermal processes 716*a,b* generally require less thermal energy than processes 712 and 714, described above (e.g., processes 716*a,b* may be performed with temperatures of between 220° F. and 700° F. and/or pressures of between 15 psig and 120 psig). As an example, processes 716*a,b* may include water distillation processes, heat-driven chilling processes, space heating processes, agriculture processes, aquaculture processes, and/or the like. For instance, an example heat-driven chiller process 716*a* may be implemented using one or more heat driven chillers. Heat driven chillers can be implemented, for example, in data centers, crypto-currency mining facilities, or other locations in which undesirable amounts of heat are generated. Heat driven chillers, also conventionally referred to as absorption cooling systems, use heat to create chilled water. Heat driven chillers can be designed as direct-fired, indirect-fired, and heat-recovery units. When the effluent includes low pressure steam, indirect-fired units may be preferred. An effluent stream 740 from all processes 712, 714, 716*a,b*, may be provided back to the wellbore 302, 500*f*.

Figure 8:
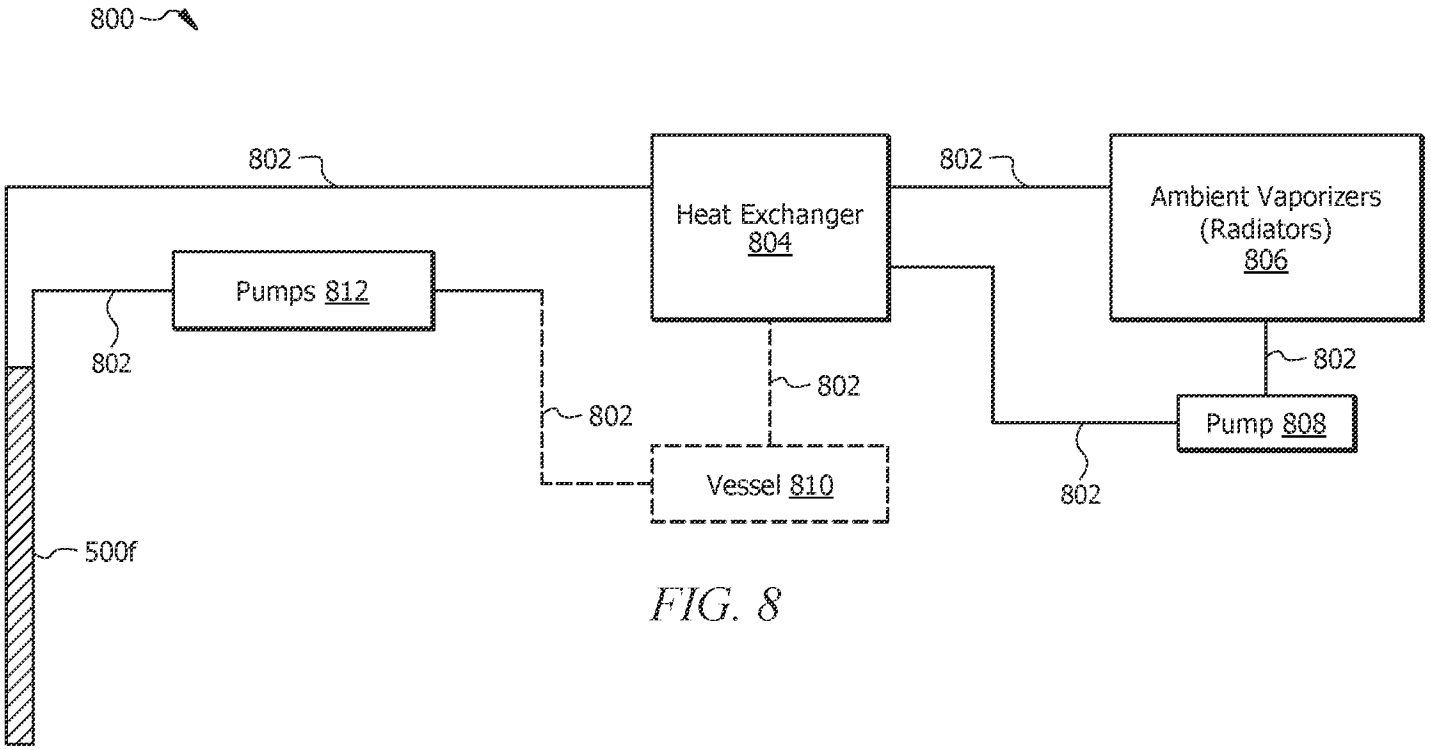
FIG. 8 is a diagram of another example system for performing thermal or heat-driven processes of FIG. 3.

FIG. 8 illustrates an example of another thermal processing system 800. Thermal processing system 800 may be coupled to a completed wellbore 500*f* to provide a flow of water or another fluid at appropriate conditions to maintain the stability of the wellbore 500*f* (e.g., before the wellbore 500*f* is used to power some process). In the example of FIG. 8, the system 800 is coupled to wellbore 500*f* of FIG. 5F. However, any other wellbore may be coupled to system 800. System 800 may be used to cycle cool fluid through the wellbore 500*f* and maintain the stability of the wellbore 500*f*. The cool fluid is flowed through the boiler casing 550 and return conduit 556 of FIG. 5F. As an example, the system 800 may provide cool water to the wellbore 500*f* under appropriate conditions (temperature, pressure, flow rate, etc.) to prevent or limit steam production by the wellbore 500*f*. In some cases, the cool fluid may be flowed in an opposite direction to that indicated in FIG. 5F such that fluid flows down the return conduit 556 and returns up through the boiler casing 550. This may help keep the fluid at a cool temperature to cool the lower portions of the wellbore 500*f*.

System 800 includes a heat exchanger 804, ambient vaporizers (or radiators) 806, a pump 808, a condensate vessel 810 and pumps 812. Fluid conduit 802 connects components of the system 800. The heat exchanger 804 includes one or more heat exchangers configured to remove heat from hot fluid received from the wellbore 500*f*. The hot fluid may be water at 100 gpm at 600° F. and 2250 pounds per square inch (psi). The ambient vaporizers (or radiators) 804 provide a cooling fluid to cool the fluid in the heat exchanger 804. Pump 808 provides flow of this cooling fluid through the heat exchanger 804. In some cases, the heat exchanger 804 may include one or more air-cooled heat exchangers that may not be coupled to the ambient vaporizers (or radiators) 804 but instead are cooled by air.

The fluid cooled in the heat exchanger 804 is provided to a condensate vessel 810. Additional fluid may be added to this vessel 810 if needed to make up for fluid losses in the system. Pump 812 includes one or more fluid pumps that pump cool fluid from the condensate vessel 810 into the wellbore 500*f* (e.g., into the inlet conduit 562, as described above). As an example, the fluid may be pumped into the wellbore 500*f* at about 100 gpm at 2500 psi and 100° F.

Example Drilling Controller

Figure 9:
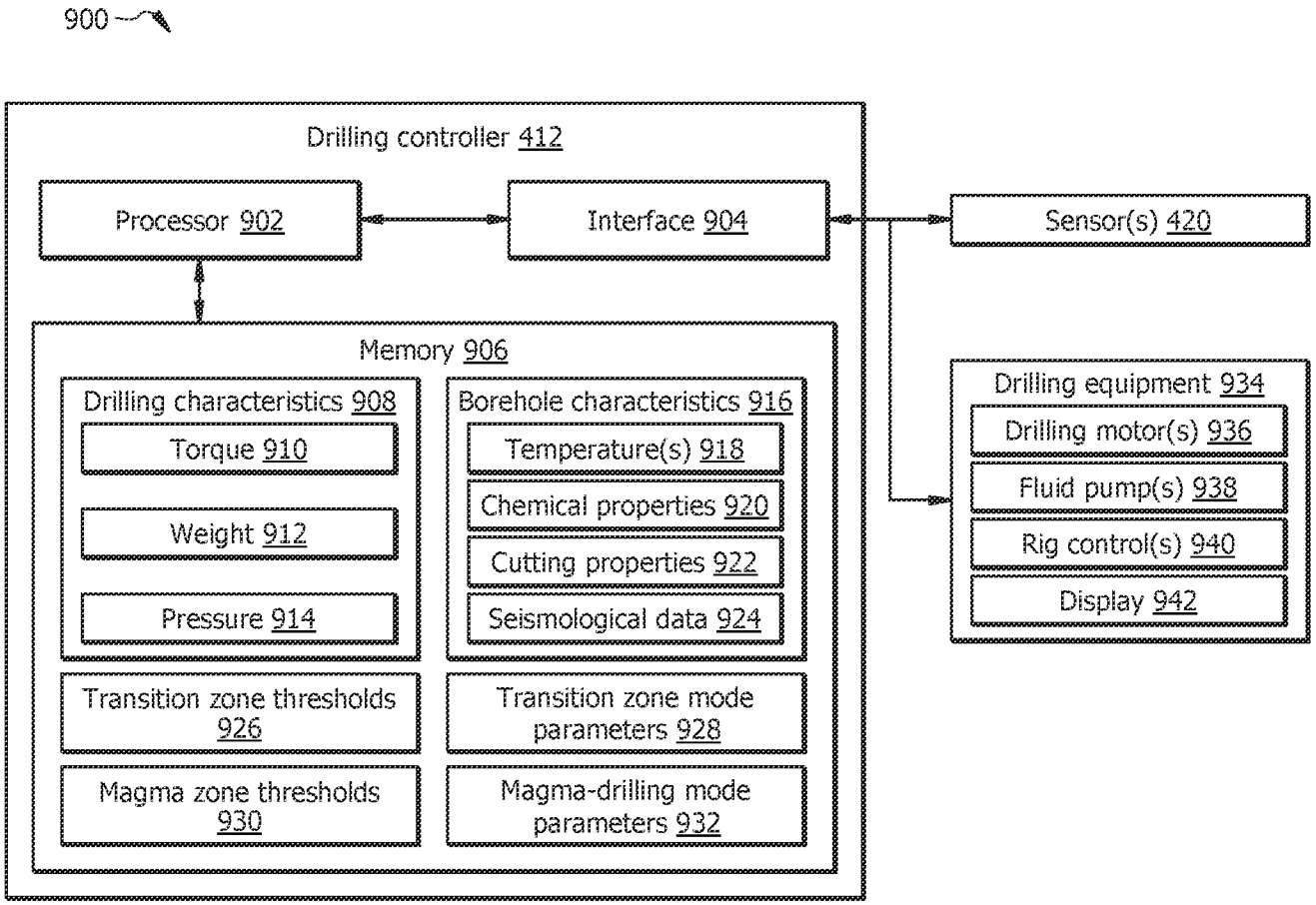
FIG. 9 is a diagram of an example drilling controller of the drilling system of FIG. 4.

FIG. 9 illustrates a device ecosystem 900 in which an example drilling controller 412 of FIG. 4 is shown in greater detail. The example controller 412 of FIG. 9 includes a processor 902, interface 904, and memory 906. The processor 902 is electronic circuitry that coordinates operations of the controller 412. The processor 902 may be a programmable logic device, a microcontroller, a microprocessor, or any suitable combination of these or similar components. The processor 902 is communicatively coupled to the memory 906 and interface 904. The processor 902 may be one or more processors. The processor 902 may be implemented using hardware and/or software.

The interface 904 enables wired and/or wireless communications of data or other signals between the controller 412 and other devices, systems, or domain(s), such as the sensors 420 and other drilling equipment 934. The drilling equipment 934 may correspond to any components of drilling system 400 illustrated in FIG. 4 or otherwise understood by a skilled person to be employed in well drilling operations. For example, the drilling equipment 934 may include one or more drilling motors 936 (e.g., to power bottom hole assembly 408 of FIG. 4), fluid pumps 938 (e.g., including but not limited to pump 424 of FIG. 4), rig controls 940 (e.g., user-operated controls of the drilling system 400 of FIG. 4), and a display 942 (e.g., an electronic display capable of displaying information determined by the drilling controller 412). The interface 904 is an electronic circuit that is configured to enable communications between these devices. For example, the interface 904 may include one or more serial ports (e.g., USB ports or the like) and/or parallel ports (e.g., any type of multi-pin port) for facilitating this communication. As a further example, the interface 904 may include a network interface such as a Wi-Fi interface, a local area network (LAN) interface, a wide area network (WAN) interface, a modem, a switch, or a router. The processor 902 may send and receive data using the interface 904. For instance, the interface 904 may send instructions to turn a pump rate to maximum and a drill rate to a slow setting when entry into a magma reservoir 214 is detected. The interface 904 may provide signals to cause a display 942 to show an indication that a magma-drilling mode is being automatically implemented or should be implemented by an operator of a drilling system associated with the controller 412.

The memory 906 stores any data, instructions, logic, rules, or code to execute the functions of the controller 412. For example, the memory 906 may store monitored drilling characteristics 908, such as a torque 910 on drill bit 410 of FIG. 4, a weight 912 on the drill bit 410, and a pressure 914 of drilling fluid provided to a wellbore being drilled. The memory 906 may also store monitored borehole characteristics 916, such as temperatures 918 of drilling fluid sent to/received from a wellbore or temperatures within a wellbore, chemical properties 920 of drilling fluid and/or gasses returned from a wellbore, cutting properties 922 of cuttings returned from a wellbore (see, e.g., sampling device 418 of FIG. 4), and vibrational or acoustic data 924 associated with a wellbore being drilled. As described in more detail with respect to the various examples above, the drilling characteristics 908 and/or borehole characteristics 916 may be used to detect when drilling has reached a transition zone 508 and/or a magma reservoir 214. For instance, the drilling characteristics 908 and/or borehole characteristics 916 may be compared to corresponding transition zone thresholds 926 to detect entry into a transition zone 508. If entry into the transition zone 508 is detected, transition zone operating parameters 928 may be used to operate the drilling equipment 934. Likewise, drilling characteristics 908 and/or borehole characteristics 916 may be compared to corresponding magma zone thresholds 930 to detect entry into a magma reservoir 214. If entry into the magma reservoir 214 is detected, magma zone operating parameters 932 may be used to operate the drilling equipment 934. The memory 906 may include one or more disks, tape drives, solid-state drives, and/or the like. The memory 906 may store programs, instructions, and data that are read during program execution. The memory 906 may be volatile or non-volatile and may comprise read-only memory (ROM), random-access memory (RAM), ternary content-addressable memory (TCAM), dynamic random-access memory (DRAM), and static random-access memory (SRAM).

Additional Embodiments

The following descriptive embodiments are offered in further support of the one or more aspects of the present disclosure.

Embodiment 1. A method, comprising:

drilling a borehole extending from a surface toward an underground magma reservoir by operating drilling equipment in a standard mode associated with drilling in non-molten rock;

monitoring drilling characteristics associated with the drilling equipment during drilling the borehole;

monitoring borehole characteristics associated with the borehole during drilling the borehole;

determining, based at least in part on the monitored drilling characteristics and the monitored borehole characteristics, that a drill bit used for drilling the borehole has entered a transition zone between a solid rock layer and the underground magma reservoir; and in response to determining that the drill bit has entered the transition zone, operating the drilling equipment in a transition zone mode, different than the standard mode, associated with drilling in an at least partially molten rock; and in response to determining that the drill bit has not entered the transition zone, continuing operating the drilling equipment in the standard mode, wherein the method optionally includes any one or more of the following limitations:

wherein monitoring the drilling characteristics comprises monitoring a torque of the drill bit during drilling the borehole; and the method further comprises determining that the drill bit has entered the transition zone when the torque is greater than a threshold torque value or increases by a threshold amount;

wherein monitoring the drilling characteristics comprises monitoring a weight on a drill bit used to drill the borehole; and the method further comprises determining that the drill bit has entered the transition zone when the weight on the drill bit decreases below a threshold weight value;

wherein monitoring the drilling characteristics comprises monitoring a pump pressure during drilling the borehole; and the method further comprises determining that the drill bit has entered the transition zone when the pump pressure changes by more than a threshold amount;

wherein monitoring the borehole characteristics comprises monitoring properties of cuttings in fluid returned from the borehole; and the method further comprises determining that the drill bit has entered the transition zone when the properties of the cuttings correspond to transition zone properties;

wherein monitoring the borehole characteristics comprises measuring an amount of one or more gaseous species returned from the borehole; and the method further comprises determining that the drill bit has entered the transition zone when the amount of the one or more gaseous species exceeds a threshold value;

wherein monitoring the borehole characteristics comprises measuring a first temperature of fluid provided into the borehole and a second temperature of fluid returned from the borehole; and the method further comprises determining that the drill bit has entered the transition zone based at least in part on one or both of the first temperature and the second temperature;

wherein monitoring the borehole characteristics comprises measuring one or more chemical and/or physical properties of fluid returned from the borehole; and the method further comprises determining that the drill bit has entered the transition zone based at least in part on the one or more chemical and/or physical properties;

wherein monitoring the borehole characteristics comprises measuring a downhole temperature in the borehole; and the method further comprises determining that the drill bit has entered the transition zone when the downhole temperature exceeds a threshold temperature value;

wherein monitoring the borehole characteristics comprises measuring vibrational or acoustic data associated with a region of the borehole; and the method further comprises determining that the drill bit has entered the transition zone based at least in part on the measured vibrational or acoustic data;

wherein operating the drilling equipment in the transition zone mode comprises providing a thermally resistant drilling fluid into the borehole;

wherein operating the drilling equipment in the transition zone mode comprises drilling at a decreased drilling rate.

Embodiment 2. A system, comprising:

drilling equipment comprising a drill bit attached to a drill string, wherein the drilling equipment is configured to drill a borehole from a surface towards an underground magma reservoir; and a drilling controller coupled to the drilling equipment and configured to:

monitor drilling characteristics associated with the drilling equipment during drilling the borehole;

monitor borehole characteristics associated with the borehole during drilling the borehole;

determine, based at least in part on the monitored drilling characteristics and the monitored borehole characteristics, that the drill bit has entered a transition zone between a solid rock layer and the underground magma reservoir; and in response to determining that the drill bit has entered the transition zone, cause the drilling equipment to operate in a transition zone mode, different than a prior mode of operation, associated with drilling in an at least partially molten rock; and in response to determining that the drill bit has not entered the transition zone, continuing operating the drilling equipment in the prior mode of operation, wherein the system optionally includes any one or more of the following limitations:

wherein the drilling controller is configured to monitor the drilling characteristics by monitoring a torque of the drill bit during drilling the borehole; and determine that the drill bit has entered the transition zone when the torque is greater than a threshold torque value or increases by a threshold amount;

wherein the drilling controller is configured to monitor the drilling characteristics by monitoring a weight on a drill bit used to drill the borehole; and determine that the drill bit has entered the transition zone when the weight on the drill bit decreases below a threshold weight value;

wherein the drilling controller is configured to monitor the drilling characteristics by monitoring a pump pressure during drilling the borehole; and determine that the drill bit has entered the transition zone when the pump pressure changes by more than a threshold amount;

wherein the drilling controller is configured to monitor the borehole characteristics by monitoring properties of cuttings in fluid returned from the borehole; and determine that the drill bit has entered the transition zone when the properties of the cuttings correspond to transition zone properties;

wherein the drilling controller is configured to monitor the borehole characteristics by measuring an amount of one or more gaseous species returned from the borehole; and determine that the drill bit has entered the transition zone when the amount of the one or more gaseous species exceeds a threshold value;

wherein the drilling controller is configured to monitor the borehole characteristics by measuring a first temperature of fluid provided into the borehole and a second temperature of fluid returned from the borehole; and determine that the drill bit has entered the transition zone based at least in part on one or both of the first temperature and the second temperature;

wherein the drilling controller is configured to monitor the borehole characteristics by measuring one or more chemical and/or physical properties of fluid returned from the borehole; and determine that the drill bit has entered the transition zone based at least in part on the one or more chemical and/or physical properties;

wherein the drilling controller is configured to monitor the borehole characteristics by measuring a downhole temperature in the borehole; and determine that the drill bit has entered the transition zone when the downhole temperature exceeds a threshold temperature value;

wherein the drilling controller is configured to monitor the borehole characteristics by measuring vibrational or acoustic data associated with a region of the borehole; and determine that the drill bit has entered the transition zone based at least in part on the measured vibrational or acoustic data;

wherein operating the drilling equipment in the transition zone mode comprises providing a thermally resistant drilling fluid into the borehole;

wherein operating the drilling equipment in the transition zone mode comprises drilling at a decreased drilling rate.

Embodiment 3. A method, comprising:

drilling a borehole extending from a surface toward an underground magma reservoir by operating drilling equipment in a standard mode associated with drilling in non-molten rock;

monitoring drilling characteristics associated with drilling equipment during drilling the borehole;

monitoring borehole characteristics associated with the borehole during drilling the borehole;

determining, based at least in part on the monitored drilling characteristics and the monitored borehole characteristics, that a drill bit used for drilling the borehole has contacted magma within the underground magma reservoir;

in response to determining that the drill bit has contacted the magma, operating the drilling equipment in a magma-drilling mode, different than the standard mode, associated with drilling inside the underground magma reservoir; and in response to determining that the drill bit has not contacted magma, continuing operating the drilling equipment in the standard mode, wherein the method optionally includes any one or more of the following limitations:

wherein monitoring the drilling characteristics comprises monitoring a torque of the drill bit during drilling the borehole; and the method further comprises determining that the drill bit has entered the magma when the torque is greater than a threshold torque value;

wherein monitoring the drilling characteristics comprises monitoring a weight on a drill bit used to drill the borehole; and the method further comprises determining that the drill bit has entered the magma when the weight on the drill bit decreases below a threshold weight value;

wherein monitoring the drilling characteristics comprises monitoring a pump pressure during drilling the borehole; and the method further comprises determining that the drill bit has entered the magma when the pump pressure changes by more than a threshold amount;

wherein monitoring the borehole characteristics comprises monitoring properties of cuttings in fluid returned from the borehole; and the method further comprises determining that the drill bit has entered the magma when the properties of the cuttings correspond to solidified magma;

wherein monitoring the borehole characteristics comprises measuring an amount of one or more gaseous species returned from the borehole; and the method further comprises determining that the drill bit has entered the magma when the amount of the one or more gaseous species exceeds a threshold value;

wherein monitoring the borehole characteristics comprises measuring a first temperature of fluid provided into the borehole and a second temperature of fluid returned from the borehole; and the method further comprises determining that the drill bit has entered the magma based at least in part on one or both of the first temperature and the second temperature;

wherein monitoring the borehole characteristics comprises measuring one or more chemical and/or physical properties of fluid returned from the borehole; and the method further comprises determining that the drill bit has entered the magma based at least in part on the one or more chemical and/or physical properties;

wherein monitoring the borehole characteristics comprises measuring a downhole temperature in the borehole; and the method further comprises determining that the drill bit has entered the magma when the downhole temperature exceeds a threshold temperature value;

wherein monitoring the borehole characteristics comprises measuring vibrational or acoustic data associated with a region of the borehole; and the method further comprises determining that the drill bit has entered the magma based at least in part on the measured vibrational or acoustic data;

wherein operating the drilling equipment in the magma-drilling mode comprises providing a thermally resistant drilling fluid into the borehole;

wherein operating the drilling equipment in the magma-drilling mode comprises drilling at a decreased drilling rate;

wherein operating the drilling equipment in the magma-drilling mode comprises causing the drill bit to move in a reciprocating motion;

wherein operating the drilling equipment in the magma-drilling mode comprises providing a drilling fluid into the borehole at an increased rate to cause magma in the magma reservoir to form a solid rock plug that can be drilled by the drill bit.

Embodiment 4. A system, comprising:

drilling equipment comprising a drill bit attached to a drill string, wherein the drilling equipment is configured to drill a borehole from a surface towards an underground magma reservoir; and a drilling controller coupled to the drilling equipment and configured to:

cause the drilling equipment to drill a borehole extending from a surface toward an underground magma reservoir using a standard mode associated with drilling in non-molten rock;

monitor drilling characteristics associated with the drilling equipment during drilling the borehole;

monitor borehole characteristics associated with the borehole during drilling the borehole;

determine, based at least in part on the monitored drilling characteristics and monitored the borehole characteristics, that the drill bit has contacted magma within the underground magma reservoir;

in response to determining that the drill bit has contacted the magma, cause the drilling equipment to operate in a magma-drilling mode, different than the standard mode, associated with drilling inside the underground magma reservoir; and in response to determining that the drill bit has not contacted magma, cause the drilling equipment to continue to operate in the standard mode, wherein the system optionally includes any one or more of the following limitations:

wherein the drilling controller is configured to monitor the drilling characteristics by monitoring a torque of the drill bit during drilling the borehole; and determine that the drill bit has entered the magma when the torque is greater than a threshold torque value;

wherein the drilling controller is configured to monitor the drilling characteristics by monitoring a weight on a drill bit used to drill the borehole; and determine that the drill bit has entered the magma when the weight on the drill bit decreases below a threshold weight value;

wherein the drilling controller is configured to monitor the drilling characteristics by monitoring a pump pressure during drilling the borehole; and determine that the drill bit has entered the magma when the pump pressure changes by more than a threshold amount;

wherein the drilling controller is configured to monitor the borehole characteristics by monitoring properties of cuttings in fluid returned from the borehole; and determine that the drill bit has entered the magma when the properties of the cuttings correspond to solidified magma;

wherein the drilling controller is configured to monitor the borehole characteristics by measuring an amount of one or more gaseous species returned from the borehole; and determine that the drill bit has entered the magma when the amount of the one or more gaseous species exceeds a threshold value;

wherein the drilling controller is configured to monitor the borehole characteristics by measuring a first temperature of fluid provided into the borehole and a second temperature of fluid returned from the borehole; and determine that the drill bit has entered the magma based at least in part on one or both of the first temperature and the second temperature;

wherein the drilling controller is configured to monitor the borehole characteristics by measuring one or more chemical and/or physical properties of fluid returned from the borehole; and determine that the drill bit has entered the magma based at least in part on the one or more chemical and/or physical properties;

wherein the drilling controller is configured to monitor the borehole characteristics by measuring a downhole temperature in the borehole; and determine that the drill bit has entered the magma when the downhole temperature exceeds a threshold temperature value;

wherein the drilling controller is configured to monitor the borehole characteristics by measuring vibrational or acoustic data associated with a region of the borehole; and determine that the drill bit has entered the magma based at least in part on the measured vibrational or acoustic data;

wherein the drilling controller is further configured to cause the drilling equipment to operate in the magma-drilling mode by providing a thermally resistant drilling fluid into the borehole;

wherein the drilling controller is further configured to cause the drilling equipment to operate in the magma-drilling mode by drilling at a decreased drilling rate;

wherein the drilling controller is further configured to cause the drilling equipment to operate in the magma-drilling mode by causing the drill bit used for drilling the borehole to move in a reciprocating motion;

wherein the drilling controller is further configured to cause the drilling equipment to operate in the magma-drilling mode by providing a drilling fluid into the borehole at an increased rate to cause magma in the magma reservoir to form a solid rock plug that can be drilled by the drill bit.

Embodiment 5. A method, comprising:

drilling an initial section of a borehole extending from a surface toward an underground magma reservoir, wherein at least a portion of the initial section of the borehole is drilled at an initial drilling rate;

detecting contact between a drill bit used to drill the borehole and magma in the underground magma reservoir; and in response to detecting contact between the drill bit and the magma:

providing a drilling fluid into the borehole to cause magma in the magma reservoir to form a solid rock plug that can be drilled by the drill bit;

drilling into the solid rock plug at a drilling rate that is less than the initial drilling rate; and moving the drill bit into contact and out of contact with the solid rock plug using a reciprocating motion, wherein the method optionally includes any one or more of the following limitations:

wherein detecting contact between the drill bit and the magma comprises determining that a torque of the drill bit is greater than a threshold torque value;

wherein detecting contact between the drill bit and the magma further comprises determining that a weight on the drill bit decreases below a threshold weight value;

wherein detecting contact between the drill bit and the magma further comprises determining that a temperature of fluid returned from the borehole is greater than a threshold temperature value;

wherein detecting contact between the drill bit and the magma further comprises determining that properties of cuttings correspond to properties of solidified magma;

wherein detecting contact between the drill bit and the magma further comprises determining that an amount of one or more gaseous species returned from the borehole is greater than a threshold value;

wherein detecting contact between the drill bit and the magma further comprises determining that a downhole temperature in the borehole is greater than a threshold temperature value;

wherein detecting contact between the drill bit and the magma further comprises determining that a temperature difference between fluid received from the borehole and provided into the borehole is greater than a threshold temperature difference value;

further comprising installing a casing in at least a portion of the initial section of the borehole;

further comprising providing the drilling fluid into the borehole at a maximum flow rate of drilling equipment used to provide the drilling fluid.

Embodiment 6. A system, comprising:

drilling equipment comprising a drill bit attached to a drill string, wherein the drilling equipment is configured to drill a borehole from a surface towards an underground magma reservoir; and a drilling controller coupled to the drilling equipment and configured to:

cause the drilling equipment to drill an initial section of a borehole extending from a surface toward an underground magma reservoir, wherein at least a portion of the initial section of the borehole is drilled at an initial drilling rate;

detect contact between the drill bit and magma in the underground magma reservoir;

in response to detecting contact between the drill bit and the magma:

cause the drilling equipment to provide a drilling fluid into the borehole to cause magma in the magma reservoir to form a solid rock plug that can be drilled by the drill bit;

cause the drilling equipment to drill into the solid rock plug at a drilling rate that is less than the initial drilling rate; and cause the drill bit to move into contact and out of contact with the solid rock plug using a reciprocating motion, wherein the system optionally includes any one or more of the following limitations:

wherein the drilling controller is further configured to detect contact between the drill bit and the magma by determining that a torque of the drill bit is greater than a threshold torque value;

wherein the drilling controller is further configured to detect contact between the drill bit and the magma by further determining that a weight on the drill bit decreases below a threshold weight value;

wherein the drilling controller is further configured to detect contact between the drill bit and the magma by further determining that a temperature of fluid returned from the borehole is greater than a threshold temperature value;

wherein the drilling controller is further configured to detect contact between the drill bit and the magma by further determining that properties of cuttings correspond to properties of solidified magma;

wherein the drilling controller is further configured to detect contact between the drill bit and the magma by further determining that an amount of one or more gaseous species returned from the borehole is greater than a threshold value;

wherein the drilling controller is further configured to detect contact between the drill bit and the magma by further determining that a downhole temperature in the borehole is greater than a threshold temperature value;

wherein the drilling controller is further configured to detect contact between the drill bit and the magma by further determining that a temperature difference between fluid received from the borehole and provided into the borehole is greater than a threshold temperature difference value;

further comprising installing a casing in at least a portion of the initial section of the borehole;

further comprising providing the drilling fluid into the borehole at a maximum flow rate of drilling equipment used to provide the drilling fluid;

wherein the drilling controller is further configured to detect contact between the drill bit and the magma by determining that a pump pressure changes more than a threshold amount.

Although embodiments of the disclosure have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. Moreover, items shown or discussed as coupled or directly coupled or communicating with each other may be indirectly coupled or communicating through some interface device, or intermediate component whether electrically, mechanically, fluidically, or otherwise.

While this disclosure has been particularly shown and described with reference to preferred or example embodiments, it will be understood by those skilled in the art that various changes in form and detail may be made therein without departing from the spirit and scope of the disclosure. Accordingly, this disclosure includes all modifications and equivalents of the subject matter recited in the claims appended hereto as permitted by applicable law. Changes, substitutions and alterations are ascertainable by one skilled in the art and could be made without departing from the spirit and scope disclosed herein. Moreover, any combination of the above-described elements in all possible variations thereof is encompassed by the disclosure unless otherwise indicated herein or otherwise clearly contradicted by context.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

What is claimed is:

1. A method, comprising:

drilling an initial section of a borehole extending from a surface toward an underground magma reservoir, wherein at least a portion of the initial section of the borehole is drilled at an initial drilling rate;

detecting contact between a drill bit used to drill the borehole and magma in the underground magma reservoir; and in response to detecting contact between the drill bit and the magma:

providing a drilling fluid into the borehole to cause magma in the magma reservoir to form a solid rock plug that can be drilled by the drill bit;

drilling into the solid rock plug at a drilling rate that is less than the initial drilling rate; and moving the drill bit into contact and out of contact with the solid rock plug using a reciprocating motion.

2. The method of claim 1, wherein detecting contact between the drill bit and the magma comprises determining that a torque of the drill bit is greater than a threshold torque value.

3. The method of claim 1, wherein detecting contact between the drill bit and the magma further comprises determining that a weight on the drill bit decreases below a threshold weight value.

4. The method of claim 1, wherein detecting contact between the drill bit and the magma further comprises determining that a temperature of fluid returned from the borehole is greater than a threshold temperature value.

5. The method of claim 1, wherein detecting contact between the drill bit and the magma further comprises determining that properties of cuttings correspond to properties of solidified magma.

6. The method of claim 1, wherein detecting contact between the drill bit and the magma further comprises determining that an amount of one or more gaseous species returned from the borehole is greater than a threshold value.

7. The method of claim 1, wherein detecting contact between the drill bit and the magma further comprises determining that a downhole temperature in the borehole is greater than a threshold temperature value.

8. The method of claim 1, wherein detecting contact between the drill bit and the magma further comprises determining that a temperature difference between fluid received from the borehole and provided into the borehole is greater than a threshold temperature difference value.

9. The method of claim 1, further comprising installing a casing in at least a portion of the initial section of the borehole.

10. The method of claim 1, further comprising providing the drilling fluid into the borehole at a maximum flow rate of drilling equipment used to provide the drilling fluid.

11. A system, comprising:

drilling equipment comprising a drill bit attached to a drill string, wherein the drilling equipment is configured to drill a borehole from a surface towards an underground magma reservoir; and a drilling controller coupled to the drilling equipment and configured to:

cause the drilling equipment to drill an initial section of a borehole extending from a surface toward an underground magma reservoir, wherein at least a portion of the initial section of the borehole is drilled at an initial drilling rate;

detect contact between the drill bit and magma in the underground magma reservoir;

in response to detecting contact between the drill bit and the magma:

cause the drilling equipment to provide a drilling fluid into the borehole to cause magma in the magma reservoir to form a solid rock plug that can be drilled by the drill bit;

cause the drilling equipment to drill into the solid rock plug at a drilling rate that is less than the initial drilling rate; and cause the drill bit to move into contact and out of contact with the solid rock plug using a reciprocating motion.

12. The system of claim 11, wherein the drilling controller is further configured to detect contact between the drill bit and the magma by determining that a torque of the drill bit is greater than a threshold torque value.

13. The system of claim 11, wherein the drilling controller is further configured to detect contact between the drill bit and the magma by further determining that a weight on the drill bit decreases below a threshold weight value.

14. The system of claim 11, wherein the drilling controller is further configured to detect contact between the drill bit and the magma by further determining that a temperature of fluid returned from the borehole is greater than a threshold temperature value.

15. The system of claim 11, wherein the drilling controller is further configured to detect contact between the drill bit and the magma by further determining that properties of cuttings correspond to properties of solidified magma.

16. The system of claim 11, wherein the drilling controller is further configured to detect contact between the drill bit and the magma by further determining that an amount of one or more gaseous species returned from the borehole is greater than a threshold value.

17. The system of claim 11, wherein the drilling controller is further configured to detect contact between the drill bit and the magma by further determining that a downhole temperature in the borehole is greater than a threshold temperature value.

18. The system of claim 11, wherein the drilling controller is further configured to detect contact between the drill bit and the magma by further determining that a temperature difference between fluid received from the borehole and provided into the borehole is greater than a threshold temperature difference value.

19. The system of claim 11, further comprising installing a casing in at least a portion of the initial section of the borehole.

20. The system of claim 11, further comprising providing the drilling fluid into the borehole at a maximum flow rate of drilling equipment used to provide the drilling fluid.

21. The system of claim 11, wherein the drilling controller is further configured to detect contact between the drill bit and the magma by determining that a pump pressure changes more than a threshold amount.

* * * * *